United States Patent [19]

Anders

[11] 4,411,336

[45] Oct. 25, 1983

[54] RAILWAY TRANSPORT BANKING SYSTEM

[75] Inventor: Walter G. Anders, North Canton, Ohio

[73] Assignee: Diebold Incorporated, Canton, Ohio

[21] Appl. No.: 319,441

[22] Filed: Nov. 9, 1981

[51] Int. Cl.[3] ..... B61D 15/12

[52] U.S. Cl. ..... 186/37; 186/28

[58] Field of Search ..... 186/7, 28, 37, 29; 109/19, 68

[56] References Cited

U.S. PATENT DOCUMENTS

| | | | |
|---|---|---|---|
| 1,118,037 | 11/1914 | Miller | 186/29 X |
| 2,613,762 | 10/1952 | McClintock | 186/37 |
| 2,904,131 | 9/1959 | Bailey | 186/37 X |
| 3,881,573 | 5/1975 | Cotter et al. | 186/37 |
| 4,015,537 | 4/1977 | Graef et al. | 186/7 X |
| 4,059,246 | 11/1977 | Anders et al. | 406/31 |
| 4,311,211 | 1/1982 | Benjamin et al. | 186/7 X |

*Primary Examiner*—Stanley H. Tollberg

*Assistant Examiner*—Kevin P. Shaver

*Attorney, Agent, or Firm*—Frease & Bishop

[57] ABSTRACT

Heavy-duty railway transport equipment for carrying out banking services between a teller terminal inside a bank and a customer terminal at a remote drive-up station visible to the teller, which transport equipment can accommodate heavy and bulky banking material loads for commercial banking transactions. The transport system includes a track-traveling car-cradle-container assembly which moves as a unit along a track connected with the terminals. The terminals each have doors normally latched closed but automatically opened upon arrival of the assembly at the terminal. The terminal doors are latched closed when moved to closed position. The container is moved to differently oriented positions at the two terminals when the terminal doors are opened for convenient access by a teller of customer. The container has a multi-pivot mounting on the car to enable such different orientation, and has a large generally rectangular top opening for easy access.

37 Claims, 25 Drawing Figures

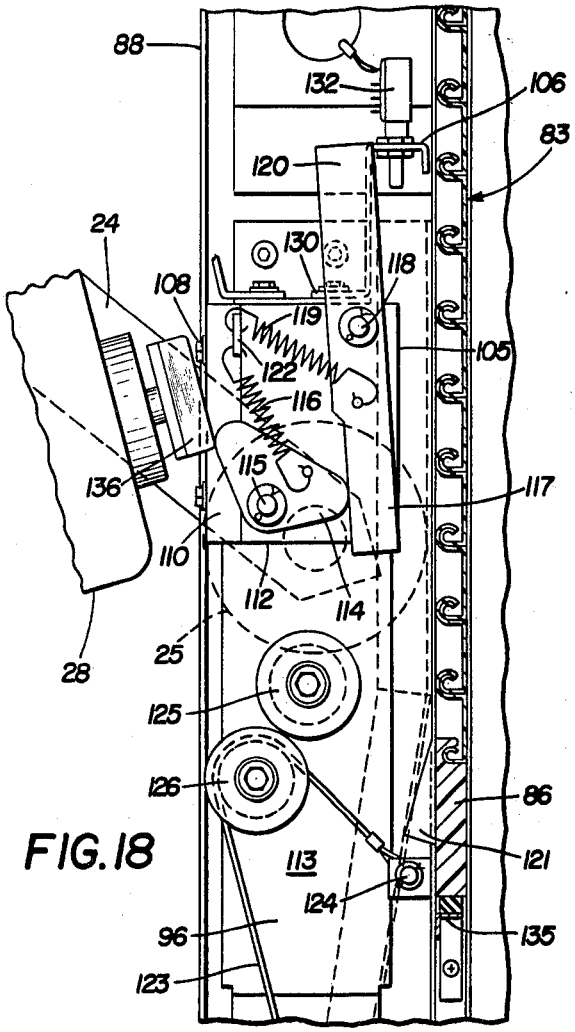
FIG. 18
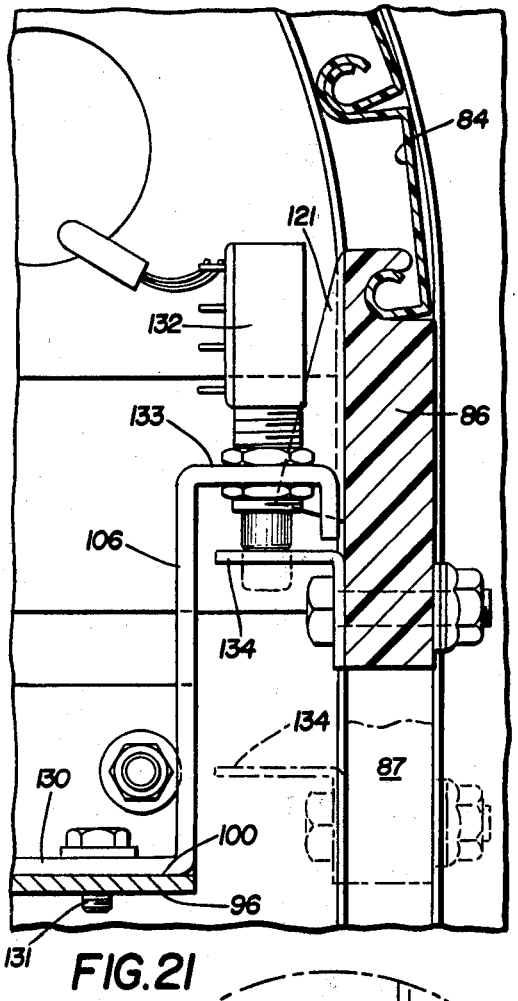
FIG. 21
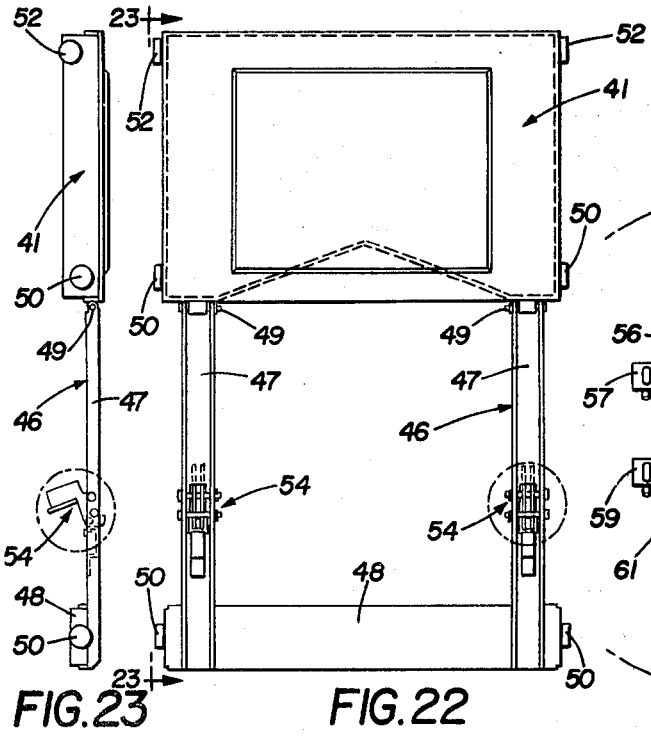
FIG. 23
FIG. 22
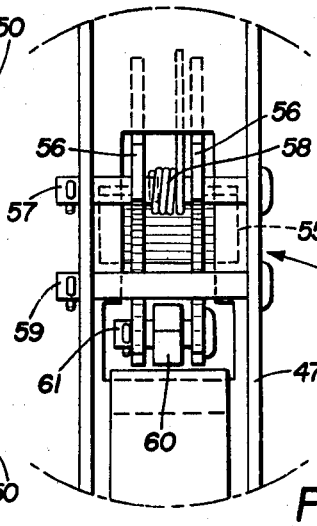
FIG. 24
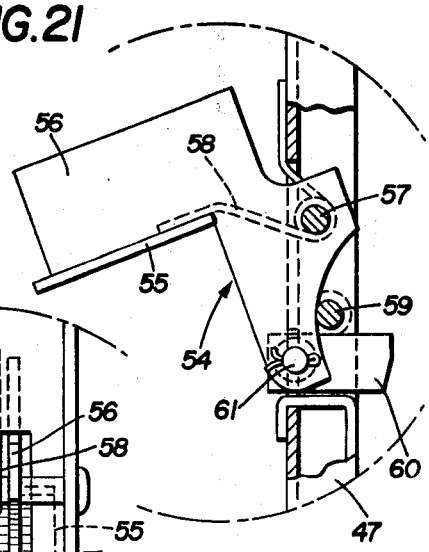
FIG. 25

RAILWAY TRANSPORT BANKING SYSTEM

CROSS-REFERENCE TO RELATED PATENTS

The new construction and system for transporting heavy or bulky loads between protected terminals involves improvements over constructions or components of devices shown in U.S. Pat. Nos. 4,015,537 and 4,059,246.

BACKGROUND OF THE INVENTION

1. Field of the Invention

The invention relates to transport equipment for carrying out banking services between a teller located inside a bank and a customer at a remote drive-up station visible to the teller. More particularly the invention relates to a heavy-duty railway transport construction for carrying out banking transactions of a commercial nature involving the movement between teller and customer terminals of heavy and bulky banking material loads. Further, the invention relates to such a heavy-duty banking material transport system in which the banking materials are moved in a large, generally rectangular boxlike open top container between the teller and customer terminals.

Also, the invention relates to equipment which locates such a container in differently oriented positions readily accessible to a teller at the teller terminal when a normally closed door for the terminal is opened, and similarly locates the container in a readily accessible position for access by a motorist customer as the customer terminal door is opened.

Also, the invention relates to such transport equipment wherein the teller and customer access opening doors are automatically opened upon arrival of the transport container at either of the terminals.

2. Description of the Prior Art

The use of pneumatic tube systems to carry out banking transactions for individuals has been popular. Such systems frequently include conveyor tubes in which carriers are moved rapidly by air pressure or vacuum through the tubes between teller and customer terminals. Usually the carriers are removable at the terminals for ease in loading or unloading into or out of the carrier, banking material for the banking transaction or operation being carried out. The customer terminal in such systems is remote from the teller terminal and the teller controlling the operation located inside of a bank. The teller has visual and audio communication with a motorist customer usually seated in an automobile at a drive-up station where the customer terminal is located. There may be a plurality of customer terminals spaced apart but served by a single teller.

A typical system of this type is shown in U.S. Pat. No. 4,059,246. However, such systems have limitations as to the bulk of and weight of banking materials to be transported between the terminals in normally standard 4 ½" or 4"×7" pneumatic tube carriers.

Typical banking transactions of a commercial nature require much larger containers for bulky documents and heavy coin to be moved between the terminals, which may involve loads of up to 25 or more pounds.

Transport containers for carrying out such commercial type banking transactions, for efficient and readily accessible use, both visibly and manually, by both the customer and the teller should have a large top opening that can be positioned conveniently close (when the customer or teller terminal is open) to a motorist customer in an automobile adjacent the customer terminal, as well as close to a teller usually standing in front of the teller terminal at a teller station which may have several teller terminals located close together served by a single teller.

An interior railway transport system is shown in U.S. Pat. No. 4,015,537 in which bulky and heavy materials may be moved from place to place in a container having a pivotally opened top lid, maintained upright and supported on a car which is selfpropelled by a motor carried by the car along a track system having horizontal and vertical track runs with bends or curves between such runs, and also having inside and outside corner bends or curves between horizontal track runs.

Such a railway track system is readily adapted for moving a heavily loaded container from a bank interior underground to a remote drive-up customer station. However, this known railway transport system has no normally closed terminal components which can protect banking materials in a transport container say 7 ½"×10 ½"×12" with an open top. Further, such prior system has no terminals with access openings through which transport container with large top openings may be exposed for convenient view to and reach by a teller standing at a teller station where several similar teller stations are located, or positioned for convenient access by a motorist customer seated in an automobile adjacent a customer terminal.

Accordingly, there is an existing need in the remote banking drive-up field for a heavy-duty transport system and construction which can accommodate the requirements of commercial type banking transactions which involve moving heavy and bulky banking material loads between teller and customer terminals, and presenting the banking materials to a customer or teller through a readily accessible wide-open top transport container at a customer or teller terminal access opening.

SUMMARY OF THE INVENTION

Objectives of the invention include providing a new heavy-duty transport construction for banking services capable of carrying a load of twenty-five or more pounds under security conditions between closed teller and customer terminals of a remote banking service installation; providing such transport construction with a self-propelled car running underground on a track between teller and customer terminals each having an access opening provided with a normally closed door that automatically opens on arrival of the car at the terminal; providing such transport construction with a large boxlike or bucketlike load-carrying container having a rectangular open top, which container is pivotally supported on a cradle which cradle, in turn, is pivotally hung on the car, and in which such pivotal axes extend at right angles to each other so that the container is maintained upright during transport between terminals but may be differently oriented when exposed at one or the other terminal upon opening the door of such terminal; providing such pivot support of the container on the cradle that permits the container to be tilted outward of the customer terminal access opening on the cradle pivotal mounting of the container when such access opening is opened; providing such container and cradle pivotal support on the car that permits the container to betilted toward a teller at the teller terminal access opening on the car pivotal mounting of the cradle when such access opening is opened; providing for the rapid physical movement of money and documents comprising banking materials of the bulk and weight described, between a teller and a motorist-customer, which cannot be so transported in standard 4 ½" diameter or 4"×7" carriers in pneumatic tube remote banking delivery systems; providing such transport construction with control mechanism at each of the teller and customer terminals which engages the container-cradle component assembly to tilt the load-carrying container to a different position at the customer terminal from that at the teller terminal, and also to a different position from that of the container when supported upright on the cradle hanging from the car during transport between said teller and customer terminals; providing such transport construction in which the control mechanism at each of the terminals that tilts the container to different positions at such terminals involves an auxiliary track in the terminal engageable with roll components on the cradle-container component assembly interrelated with car movement on the car track which extends between the terminals; providing such transport construction in which the normally closed doors for the teller and customer terminal access openings are latched closed by latch mechanisms in the normally closed door positions, and in which there is an interrelated interengaging relationship between the latch mechanisms and the cradle-container component assembly which unlatches the door latch mechanism at each terminal as the car arrives at either such terminal; and providing a construction, arrangement and operation of such heavy-duty transport construction or system components which is relatively simple and reliable in construction and operation, and is readily serviced, and which satisfies the indicated objectives and existing needs in the field of providing banking services at remote motorist-customer banking installations.

These and other objectives and advantages may be obtained by the heavy-duty transport construction which, in general terms, may be described as banking service transport equipment for carrying out banking transactions between a teller station and a remote customer station, including a teller terminal, a customer terminal, and a self-propelled car transport mechanism connecting said teller and customer terminals of a type in which a car travels along a track system having horizontal and vertical track runs with curves between horizontal and vertical runs and a corner curve between horizontal run portions; a container; and multi-axis pivotal mechanism suspending the container from the car for pivotal movement on a first pivot axis at one of said teller and customer terminals and on a second pivot axis oriented at right angles to said first axis at the other of said terminals.

BRIEF DESCRIPTION OF THE DRAWINGS

A preferred embodiment of the invention—illustrative of the best mode in which applicants have contemplated applying the principles—is set forth in the following description and shown in the drawings, and is particularly and distinctly pointed out and set forth in the appended claims.

FIG. 18 is a view similar to FIGS. 16 and 17 showing the container just before arriving at "home" position;

FIG. 21 is an enlarged fragmentary sectional view looking in the direction of the arrows 21—21, FIG. 12 of an upper righthand corner of the parts shown in FIG. 19 as the door for the teller terminal has just been moved to closed position;

FIG. 22 is an elevation of the carriage for the customer terminal door;

FIG. 23 is a side view looking in the direction of the arrows 23—23, FIG. 22 of the parts shown in FIG. 22.

FIG. 24 is an enlarged view of a portion of FIG. 22 encircled with a dot-dash line in FIG. 22; and FIG. 25 is an enlarged view of the parts encircled with a dot-dash line in FIG. 23.

Similar numerals refer to similar parts throughout the drawings.

DESCRIPTION OF THE PREFERRED EMBODIMENT

Figure 1:
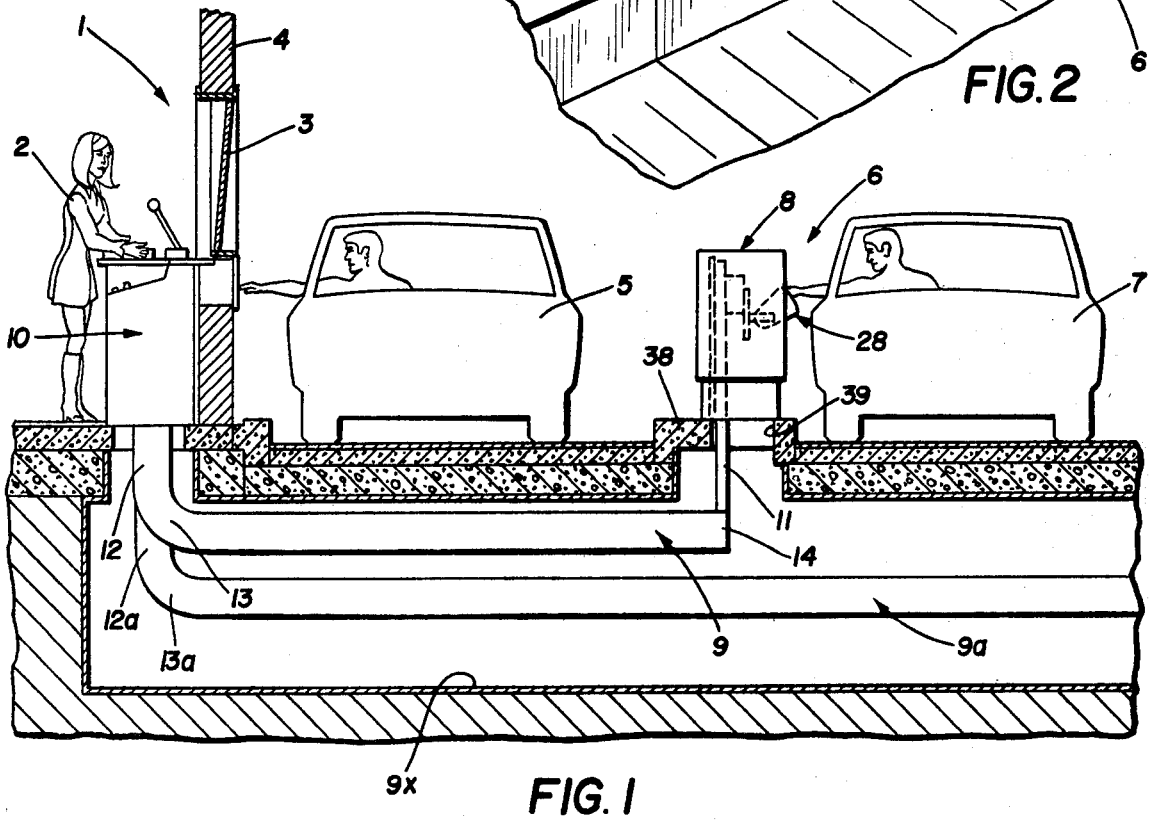
FIG. 1 is a diagrammatic view of a remote banking installation illustrating two motorist-customers being served by a single teller at a teller station, and illustrating an improved customer terminal at a drive-up station remote from the teller being served by the heavy-duty transport device as well as another customer being served by the teller at a drive-up window located at the teller station.

An installation of the new remote heavy-duty bank drive-up transport equipment for carrying out commercial banking services or operations is shown diagrammatically in FIG. 1. A teller station is indicated generally at 1 served by a teller 2 located preferably at a drive-up window 3 in a wall 4 of a bank building. The teller 2 can serve a drive-up customer in an automobile 5 directly at the drive-up window 3 without transport equipment other than a usual deal drawer.

A remote customer drive-up station is indicated generally at 6 visible to teller 2 through the window 3. A customer in an auto 7 has convenient access to a remote customer terminal indicated generally at 8 when arriving at station 6. There may be one or more other remote customer drive-up terminals similar to terminal 8 at additional customer stations (not shown) located to the right of the customer station 6 shown in FIG. 1. The customer station 6 is representative of any such additional adjacent customer terminals and stations.

Figure 2:
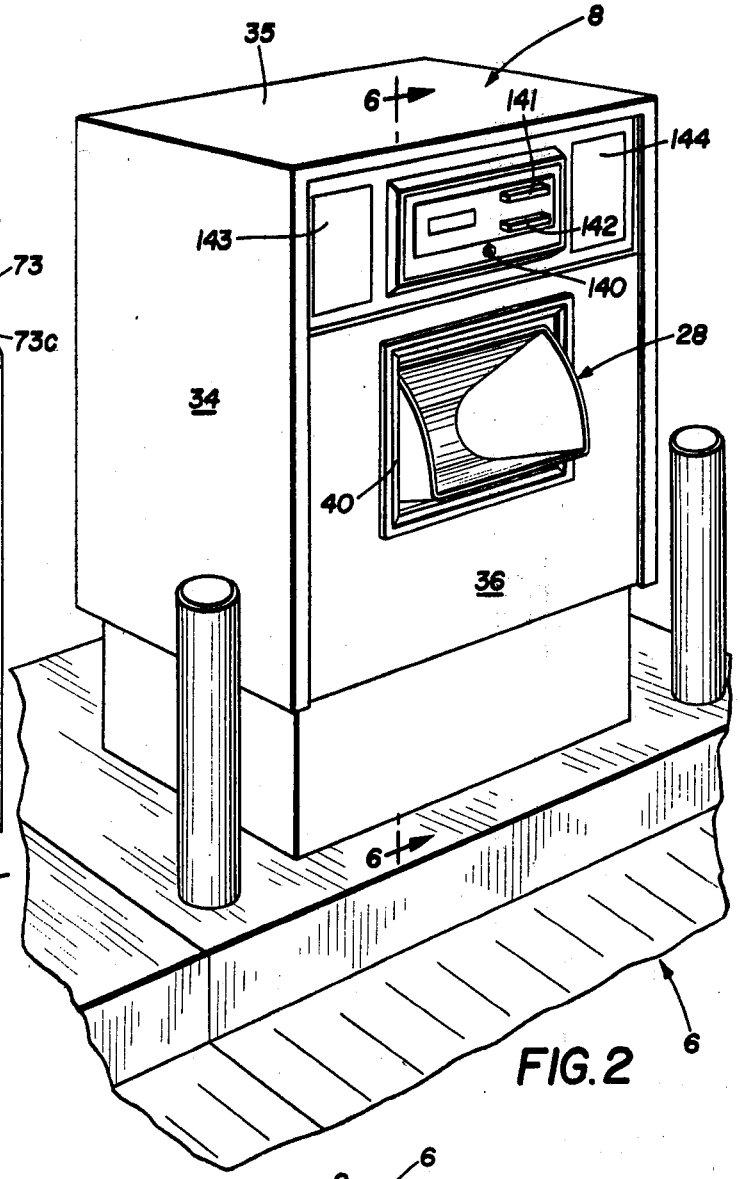
FIG. 2 is a perspective view of an improved customer terminal for the transport installation of FIG. 1.
Figure 9:
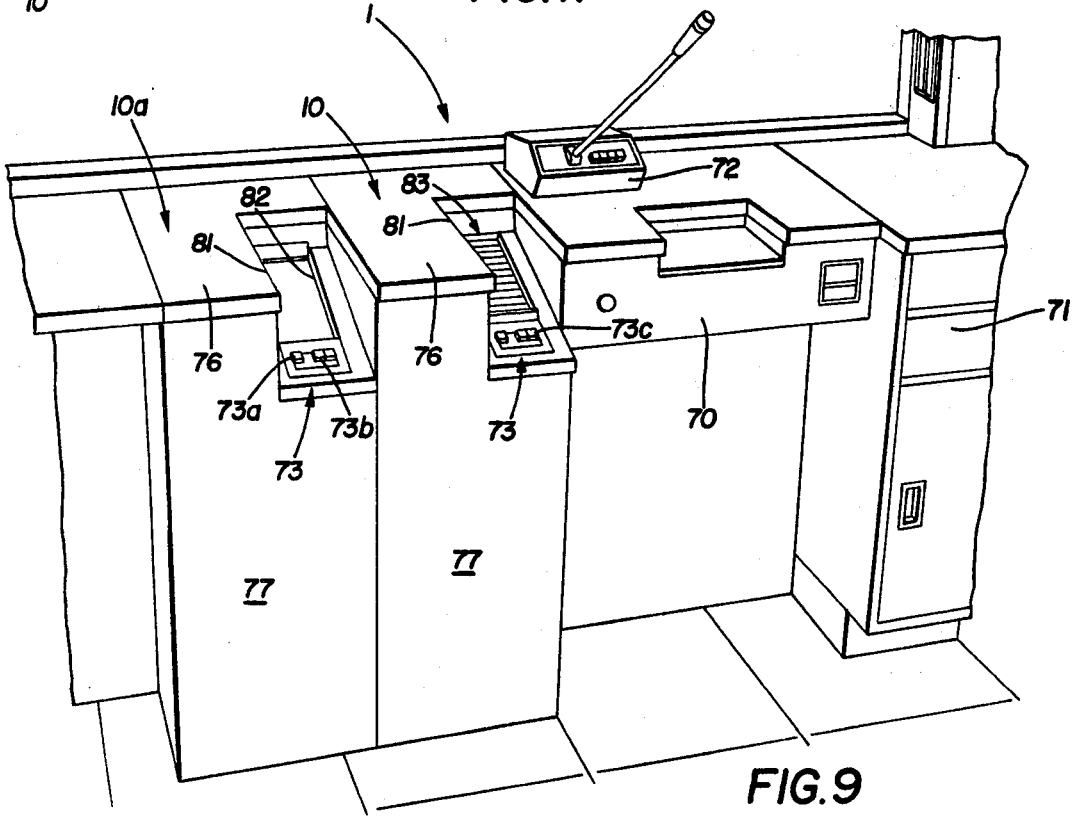
FIG. 9 is a diagrammatic perspective view of a teller station inside of a bank, such as shown in FIG. 1, equipped with several teller terminals, one for each of several remote customer stations.

The customer terminal 8 has trackway transport communication generally diagrammatically indicated at 9 with its related teller terminal located at the teller station 1, and indicated generally at 10 in FIG. 9. Trackway generally indicated at 9*a* in FIG. 1 extends from a second customer terminal similar to customer terminal 8, but not shown, to its related teller terminal generally indicated at 10*a* in FIG. 9. The two teller terminals 10 and 10*a* are narrow in width and are located side by side at the teller station 1 as shown in FIG. 9, one of the teller terminals, such as terminal 10, being shown individually in FIG. 3. Similarly, one of the customer terminals, such as terminal 8, is illustrated in FIG. 2 at a customer drive-up station 6.

The transport trackways 9 and 9*a* extend underground through a tunnel 9*x* which communicates between the bank interior and all of the customer stations. The ends of the trackway system having portion 9 extend vertically upward at 11 and 12 to the customer and teller terminals 8 and 10. Trackway portions 9 and 12 are connected by a curve 13, and portion 9 at its other end extends around a corner curve 14 and horizontally along portion 9-1 to a track curve 13-1 connected with track portion 11.

Similarly, trackway portion 9*a* is connected by curve 13*a* with upright portion 12*a*, and portion 9*a* at its other end (not shown) is connected with a customer terminal paired with the teller terminal 10*a*. Thus, the respective customer and teller terminals are transport-connected in pairs.

Figure 4:
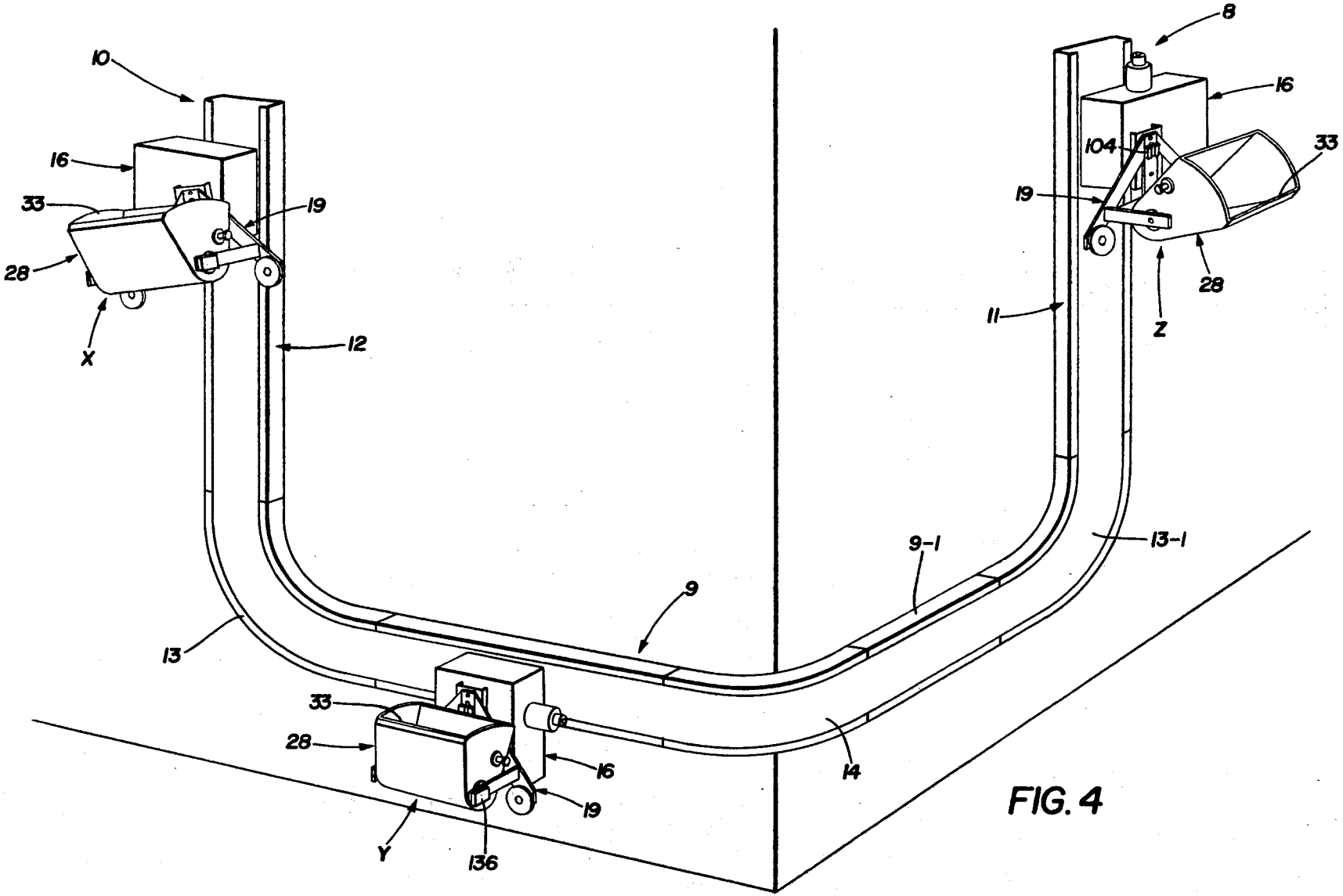
FIG. 4 is a diagrammatic perspective view generaly illustrating the type of track layout used in the remote banking service installation of FIG. 1, and illustrating car, cradle and load-carrying container component assemblies at various positions along the track system.

One of the paired-terminal trackway systems, such as that connecting customer terminal 8 and teller terminal 10, is illustrated diagrammatically in FIG. 4. It shows the upright or vertical trackway portion 12 connected by curve 13 to horizontal trackway portion 9. The trackway also extends around corner curve 14 to another horizontal portion 9-1 and to curve 13-1 and vertical or upright track portion 11.

This railway-trackway system thus illustrated in FIG. 4 is similar to the railway transport track system of U.S. Pat. No. 4,015,537. The remote banking installation of FIG. 1 is similar in terminal arrangement to the typical pneumatic tube system banking service installation of U.S. Pat. No. 4,059,246.

The trackway system extending between each customer station and its connected teller station has security terminals at the ends of such trackway system which characterize and are an important aspect of the invention. Further, there is a separate trackway system for each pair of customer-teller-terminals.

Figure 5:
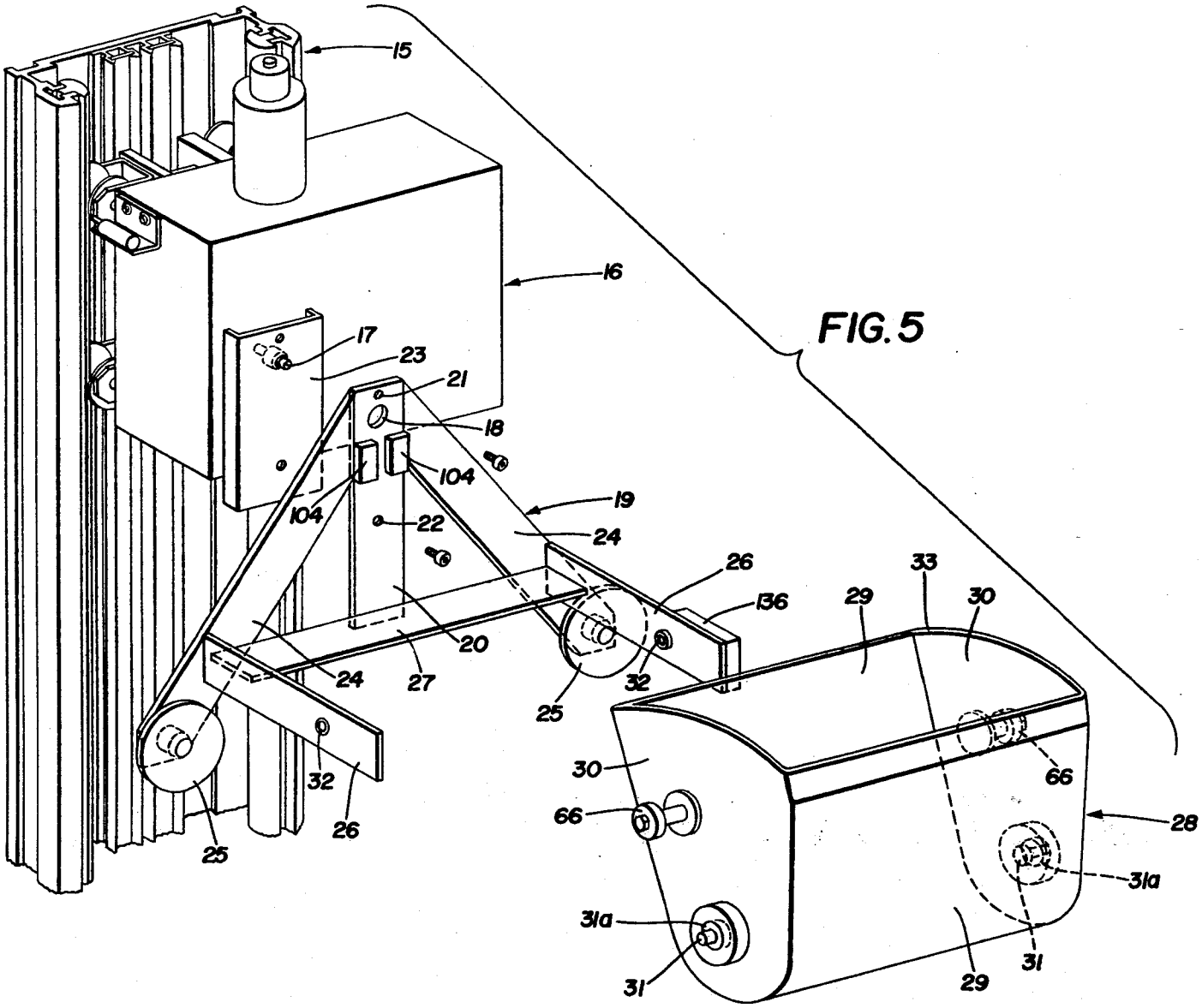
FIG. 5 is an enlarge exploded perspective view of the car-cradle-container components assembly illustrated in FIG. 4.

The construction of the track used in the trackway system illustrated in FIGS. 1 and 4, a portion of which track is indicated generally at 15 particularly in FIG. 5 and also in other figures of the drawings corresponds to the track construction shown and described in U.S. Pat. No. 4,015,537. Also, the self-propelled car generally indicated at 16 traveling on the track 15 and its construction and operation on the track 15 are similar to the car and its operation, as shown and described in said U.S. Pat. No. 4,015,537. The illustration and description of the construction and operation of such track and self-propelled car in said U.S. Pat. No. 4,015,537 accordingly is incorporated by reference herein without repeating.

The car 16 is provided with a pivotally mounted shaft 17 from which a cradle generally indicated at 19 is suspended preferably by bolting a vertical member 20 at 21 and 22 to a pivot frame 23 welded to pivot shaft 17 so that the cradle 19 and frame 23 are suspended from and hang downward from the pivot shaft 17. In bolting the cradle 19 to pivot frame 23 an opening 18 formed in the cradle assembly slips over the end of pivot shaft 17. Thus, the cradle 19, pivot frame 23, and pivot 17 are integral so that the cradle 19 may swing laterally about the axis of the pivot shaft 17 which pivot shaft is journaled in bushings 17*a* within the car 16.

The cradle 19 has downwardly diverging arms 24 on the ends of which cradle control wheels or rollers 25 are journaled. Spaced support members 26 project away from the car and from the arms 24 adjacent the rollers 25. The support members 26 are braced by brace member 27 connected at its ends to the support members, and also connected midway with the vertical member 20 as shown in FIG. 5.

A load-carrying container generally indicated at 28, having side walls 29 and end walls 30, is pivotally mounted on the outer ends of the support members 26. Pivot pin bolts 31 project outward through bushings 31*a* provided in the lower portions of the container end walls 30 and are threaded into the openings 32 in support members 26. The container side walls 29 preferably are connected by a curved bottom wall and the container has a generally rectangular open top 33.

In this manner, the container 28 is pivotally mounted on the cradle 19 on an axis extending at right angles to the axis of the pivot mounting 18 of the cradle on the car pivot shaft 17. This multiple pivot mounting of the container 28 on the car 16 is another important aspect of the invention.

Referring to FIG. 4, the multiple pivot mounting of the container 28 on the car 16 permits the container 28 to be tilted endwise on the pivot shaft 17, as shown at X, enables the container 28 to hang in a vertical position at all times while the car 16 is traveling on the trackway, as indicated at Y, and permits the container 28 to be tilted laterally outward on the pivot pins 31, as indicated at Z.

Of course, there is only one car-cradle-container assembly on any one trackway, the three different locations of such assemly at X, Y and Z being for illustrative purposes.

Another important aspect of the invention involves the dimensional characteristics of the load-carrying container 28 and their relationship to other components of the equipment. Container 28, in order to transport bulky banking material and heavy loads of 25 pounds or more, preferably has an open top 33 generally rectangular in shape 12" long and 7 ½" wide and a container depth of about 10 ½". In this manner the container 28 projects a minimum distance, mounted on the cradle 19, outward away from the car 16 determined by the ∂½" lateral width of the container open top. Further, this relationship provides a maximum length endwise of the container 28 when tilted, either on the pivot shaft 17 with respect to the car 16, or on the pivot pins 31 with respect to the cradle 19, for reasons described in detail below.

THE CUSTOMER TERMINAL

The customer terminal 8 and its construction and operation with respect to the other components of the equipment are illustrated in FIGS. 1, 2, 6, 7, 8, 22, 23, 24 and 25 and are described in detail below. Only one customer terminal 8 is described in detail since each terminal is the same where a plurality of remote customer terminals are installed as a part of a remote banking installation having a plurality of customer stations.

The terminal 8 has a housing comprising side walls 34, a top wall 35, a front wall 36, and a back wall 37. The terminal housing is mounted on a foundation portion 38 and its open lower end communicates through opening 39 with the tunnel 9*x*.

Figure 6:
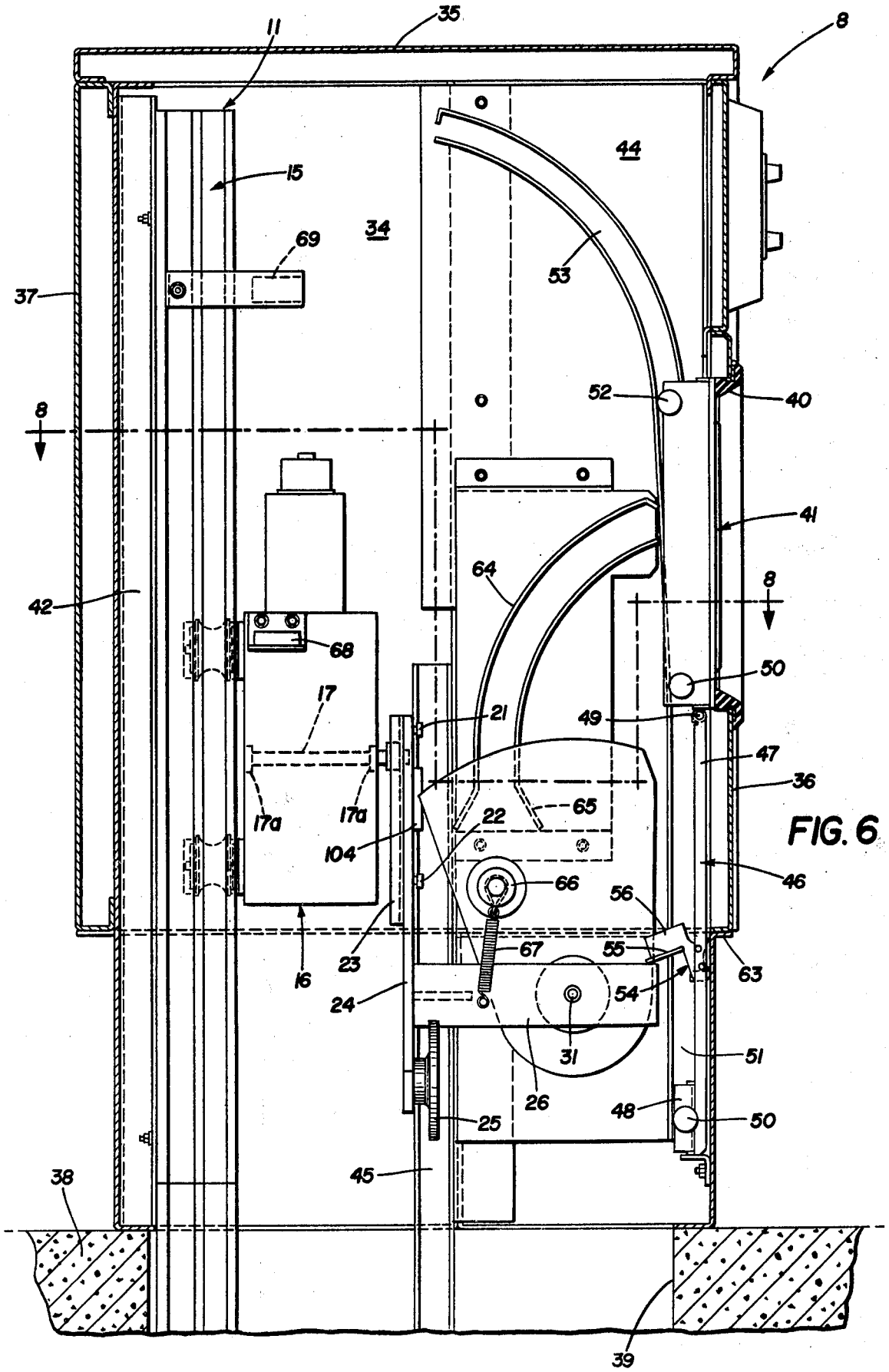
FIG. 6 is a vertical sectional view taken on the line 6—6, FIG. 2, illustrating the improved customer terminal construction with a car approaching a "home" position in the terminal.
Figure 8:
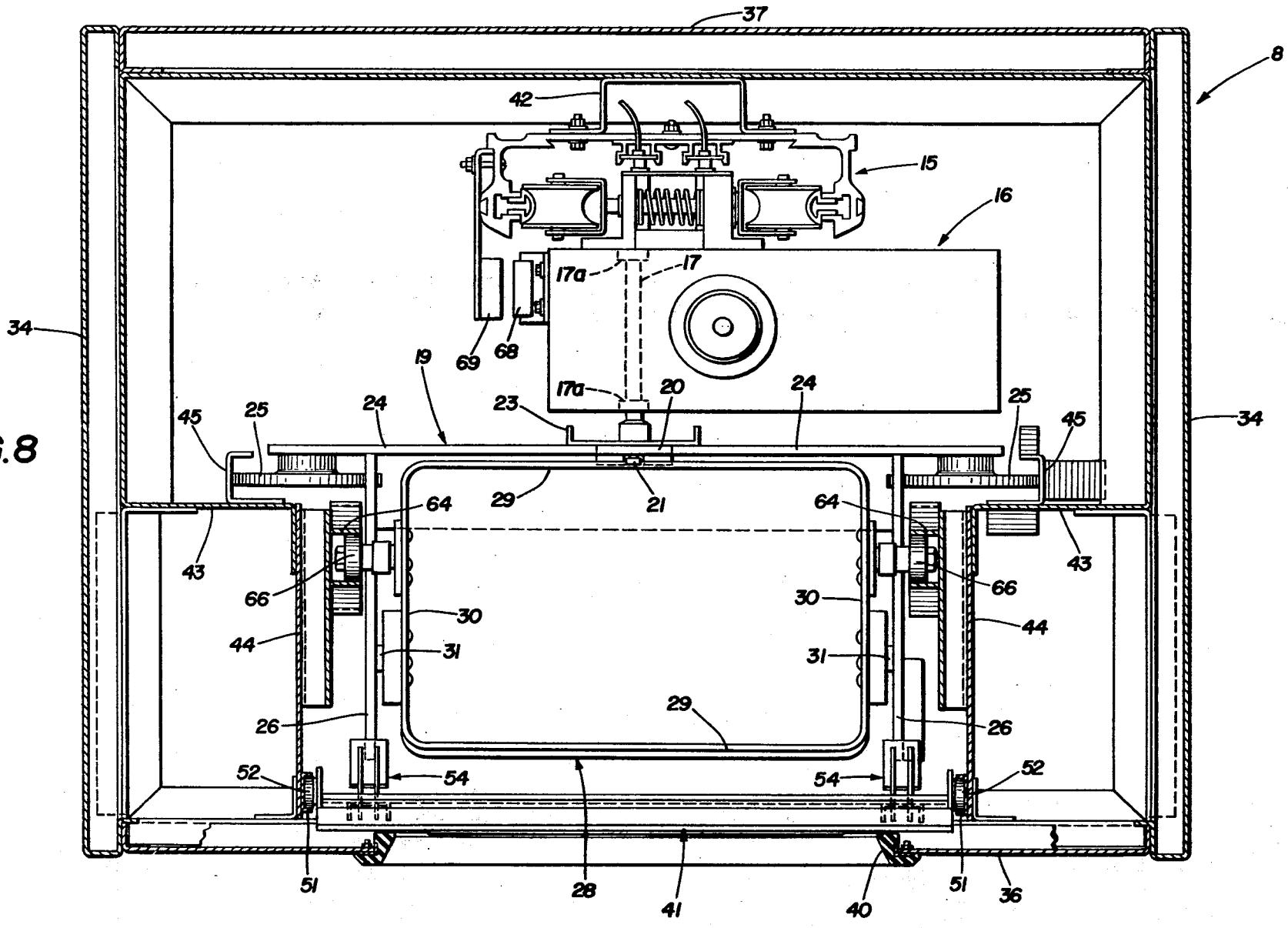
FIG. 8 is a horizontal plan sectional view looking in the direction of the arrows 8—8, FIG. 6.
Figure 11:
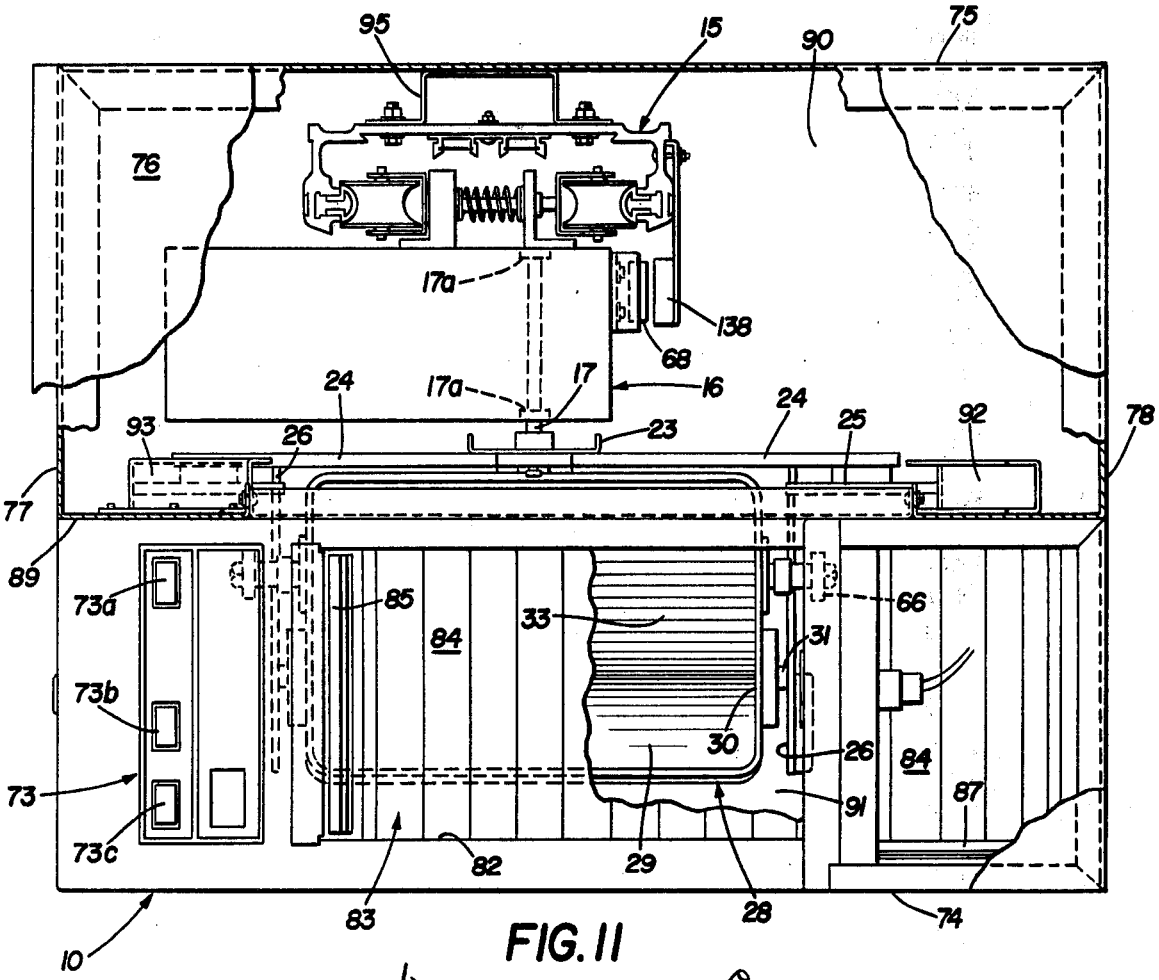
FIG. 11 is a top plan view with parts broken away and in section looking in the direction of the arrows 11—11, FIG. 10.

The front wall 36 is provided with an access opening formed by a frame 40 normally closed by a door generally indicated at 41. The track 15 along which the car 16 travels at the upper end of the upright or vertical trackway portion 11 of trackway system 9 is mounted within and in fixed relation with respect to the terminal 8 by upright channel 42 (FIGS. 6 and 8). Upright, boxlike walls 43 and 44 are provided within the front corners of the housing of customer terminal 8 (FIG. 8). Stabilizing tracks 45 extend vertically on the box walls 43 laterally spaced within the terminal housing to engage the cradle control rollers 25 and guide and stabilize the cradle 19 as a car 16 moves upward into the customer terminal 8 (FIG. 6).

A carriage frame generally indicated at 46 (FIG. 22), generally rectangular in shape, is formed by upright channel members 47, a lower cross member 48 and an upper pivot shaft 49. The carriage frame rollers 50 at each of the four corners of frame 46 are engaged in vertical channel tracks 51 mounted in opposite spaced relation on the box walls 44 adjacent the access opening 40.

The lower portion of door 41 is pivotally mounted on the upper pivot shaft 49 of carriage frame 46 (FIGS. 22 and 23) and the upper corners of door 41 are provided with guide rollers 52 similar to carriage frame guide rollers 50.

Figure 7:
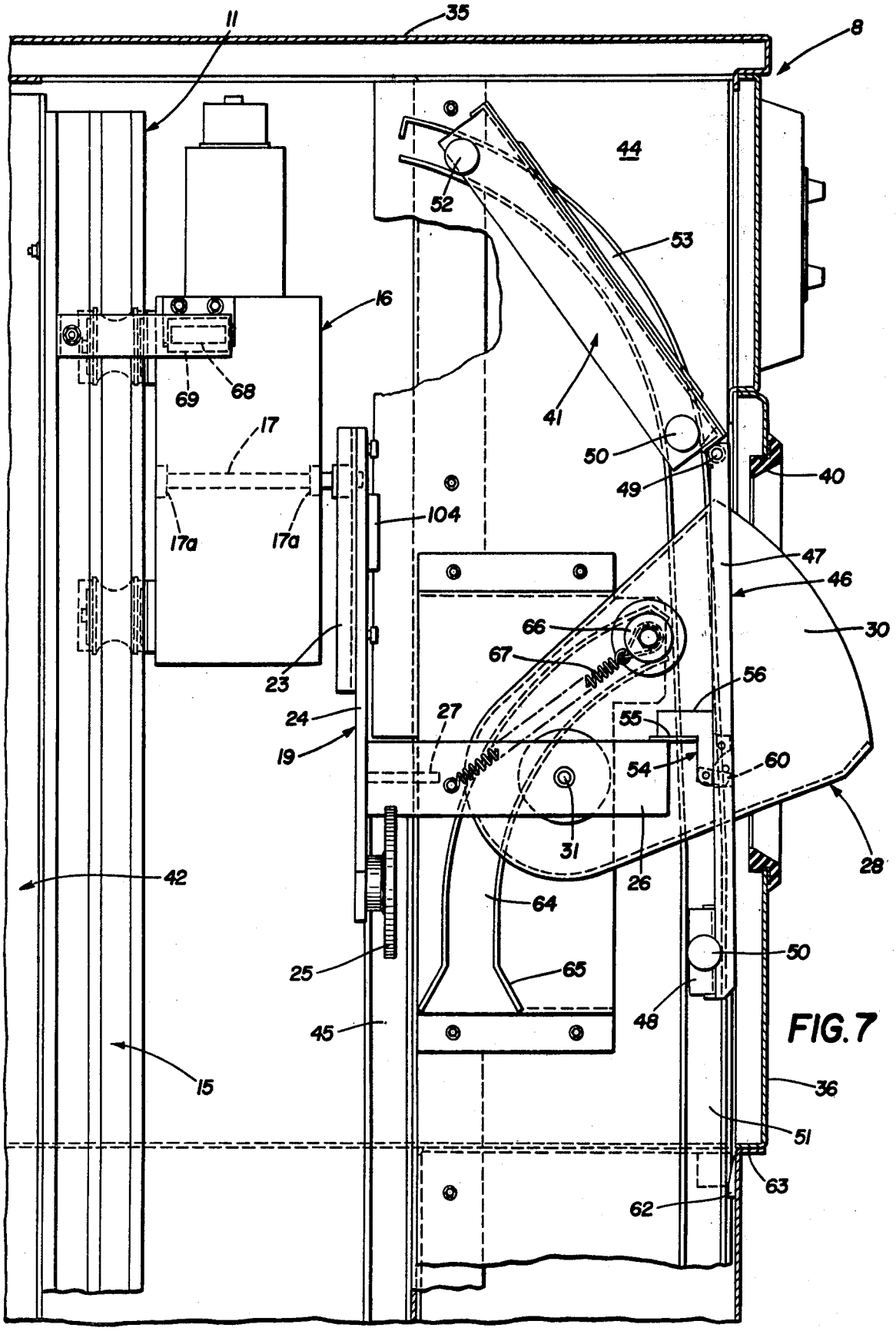
FIG. 7 is a view similar to FIG. 6 showing the car stopped at the "home" position in the customer terminal with the terminal door open and the container positioned for easy access by a motorist-customer.

Curved door guide channel tracks 53 also are mounted in spaced relation on the box walls 44 within the terminal housing, connected with the upper ends of the vertical channel tracks 51, along which the upper door guide rollers 52 travel to move the door 41 from the closed position of FIG. 6 to the open position of FIG. 7 when the door carriage frame 46 is moved upward.

The upright carriage frame channels 47 are provided with latch mechanisms generally indicated at 54 for locking the carriage frame 46 and door 41 normally in door closed position as illustrated in FIG. 6. Each latch mechanism 54 (FIGS. 24 and 25) has a strike plate 55 mounted on spaced L-shaped latch members 56 pivotally mounted at 57 on an upright carriage channel 47, biased by spring 58 counterclockwise (FIG. 25) about pivot 57 with biased movement limited by stop pin 59. A catch finger 60 is pivotally mounted at 61 on the lower ends of and between L-shaped latch members 56 projecting outward from the channel members 47. Catch fingers 60 are engaged under catch plates 62 mounted on the inside of the housing front wall 36 at the shoulder 63 formed in the housing front wall 36 (FIGS. 6 and 7) when the carriage frame 46 and door 41 are in door-closed position to latch or lock the door closed.

As a car-cradle-container assembly 16-19-28 approaches the customer terminal 8 along track portion 15, the outer ends of the support members 26 engage the strike plates 55 of latch mechanisms 54 (FIG. 6) and release the catch fingers 60 from the catch plates 62. Continued upward movement of the cradle through support member engagement with the latch plates raises the carriage frame 46 and door 41 mounted thereon from the closed position of FIG. 6 to the open position of FIG. 7.

Spaced curved container control channel tracks 64 also are mounted within the housing on box walls 44 and tracks 64 have lower flared ends 65. As the car-cradle-container assembly rises within the customer terminal from the position shown in FIG. 6 to that of FIG. 7, the container control rollers 66 mounted on the container end walls 30 near an upper corner thereof enter the flared ends 65 of curved channel tracks 64 to pivotally tilt the container on pivot pins 31 so that when the door 41 is in open position, the container 28 is tilted laterally outward through the access opening formed by the frame 40 as shown in FIGS. 1 and 7 with the long dimension of the open top 33 generally parallel with the auto in which a customer 7 is seated. The large rectangular top opening of the container 28 thus is accessible in a most advantageous tilted position and location so that the customer 7 can insert or withdraw banking materials easily into and out of the container 28, being able to peer into the interior of the container.

When the customer terminal door 41 is closed as hereinafter described, the container control spring 67 assures that the container returns to the position of FIG. 6 despite the presence of a heavy load of banking materials that may have been deposited into the container by the customer when the container was in laterally outwardly tilted position of FIG. 7, over center from the upright position of FIG. 6.

The car 16 (FIGS. 6, 7 and 8) has a permanent magnet 68 mounted thereon which actuates a limit reed switch 69 mounted on the upper end of the track 15 when the car arrives at the door open position of the customer terminal as shown in FIG. 7. Actuation of the reed switch de-energizes the drive motor of the self-propelled car 16 so as to stop the car-cradle-container assembly movement upon arrival thereof at the door open position of the customer terminal.

THE TELLER TERMINAL

Figure 3:
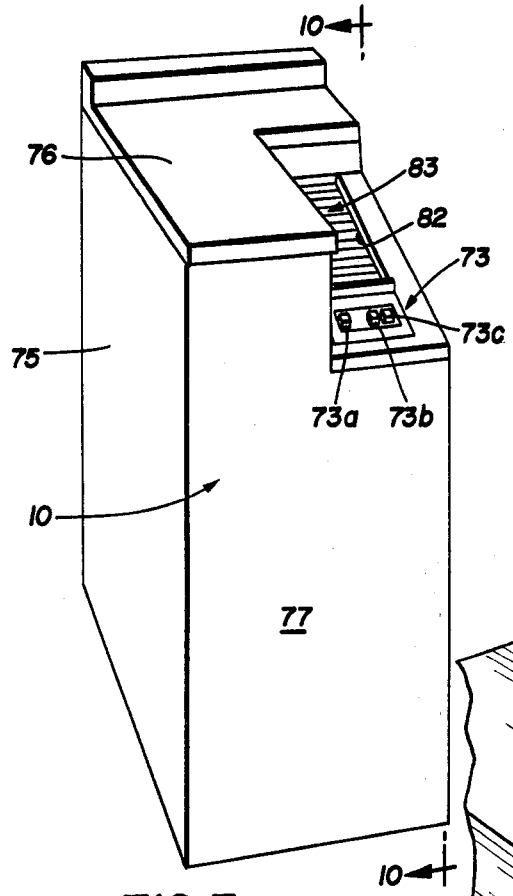
FIG. 3 is a perspective view of an improved teller terminal located at the teller station of FIG. 1 serving one remote customer terminal.

The teller terminal 10 and its construction and operation with respect to the other components of the equipment are illustrated in FIGS. 1, 3 and 9 to 21 and are described in detail below. Only one teller terminal 10 is described in detail since each terminal is the same where a plurality of teller terminals are installed at a teller station within a bank as a part of a banking installation having a plurality of remote customer stations. In such an installation there will be one teller terminal 10 paired with each customer terminal 8. A single teller terminal 10 is shown in FIG. 3 while a plurality of teller terminals 10 and 10*a* are shown in FIG. 9 at the teller station 1.

In order to conserve space and promote convenience for a teller standing at the teller station which may include a desk 70 and other cabinet equipment 71, the teller terminals 10 or 10*a* should have minimum width laterally of one another when installed, particularly when multiples are involved.

The teller station is provided with audio equipment 72 for verbal communication with any customer at any connected remote customer station, and each teller terminal may have a series of control buttons generally indicated at 73.

Each teller terminal 10 has a housing comprising side walls 74 and 75, a top wall 76, a front wall 77 and a back wall 78. The terminal housing is mounted on a floor portion 79 of the bank building and its open lower end communicates through floor opening 80 with the tunnel 9*x*.

The top wall 76 of teller terminal is cut away at 81 to provide a recessed downwardly forwardly slanting access opening 82 for the teller terminal 10 closed by a door generally indicated at 83. The door 83 preferably is a flexible roll-top desk type door formed by a series of tambour slats 84 so that it may move in a curved path during opening and closing. The door 83 is provided with a front handle 85 extending laterally at the front or forward end of the door and a cross member 86 at its rear end.

Figure 12:
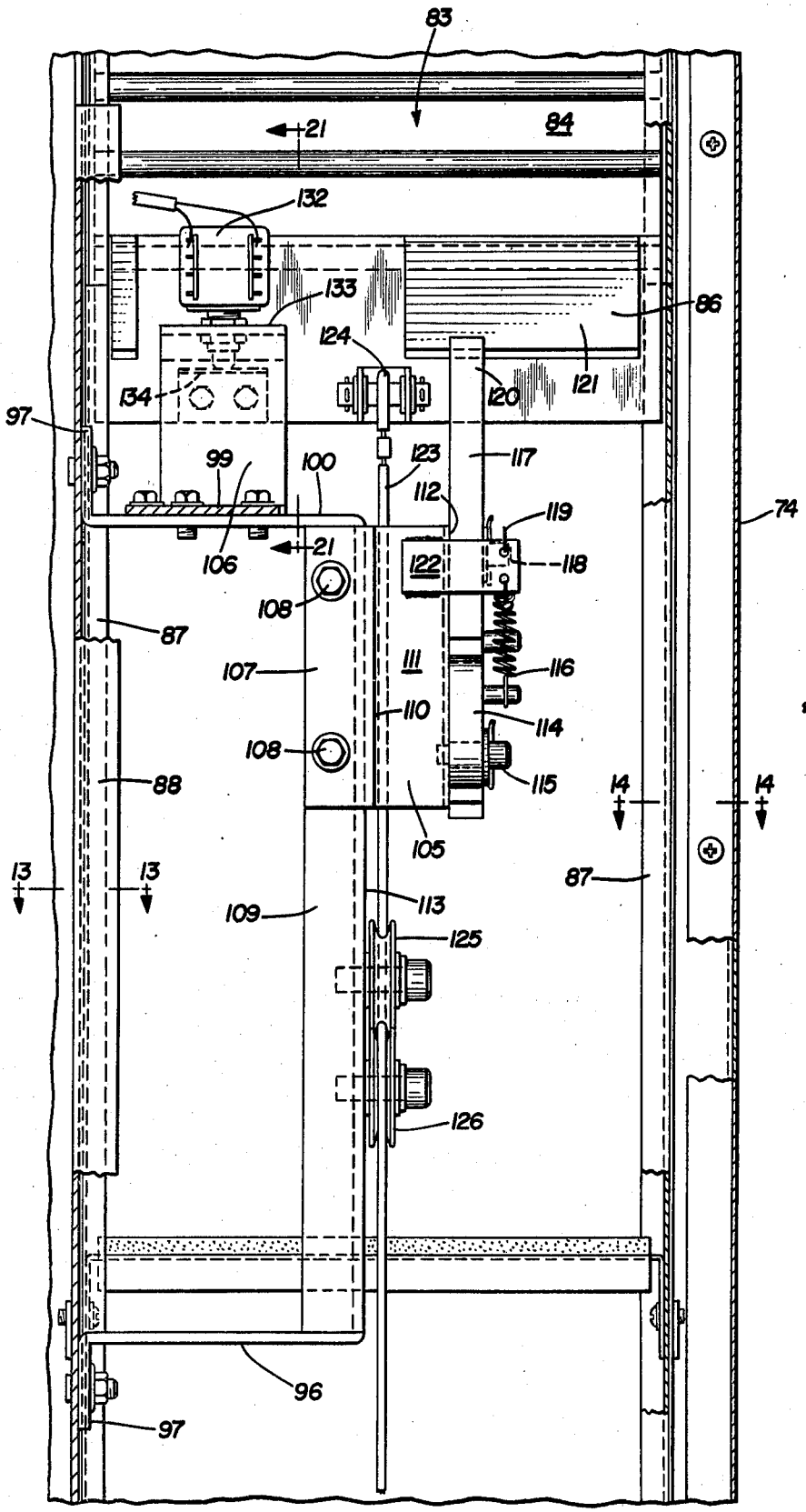
FIG. 12 is a substantially enlarged sectional view looking in the direction of the arrows 12—12, FIG. 10.
Figure 13:
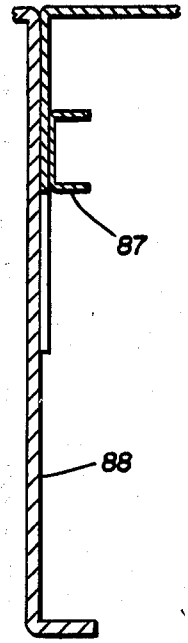
FIG. 13 is a sectional view taken on the line 13—13, FIG. 12.
Figure 14:
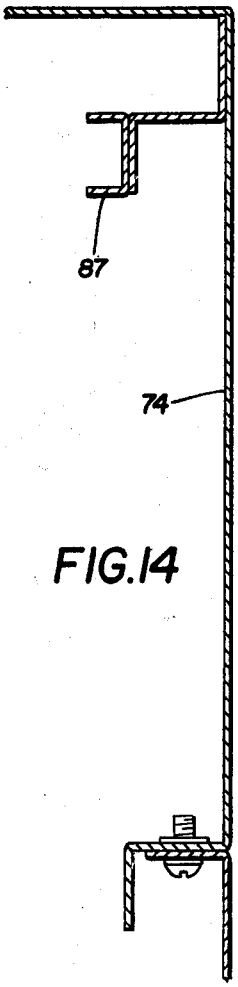
FIG. 14 is a sectional view looking in the direction of the arrows 14—14, FIG. 12.

The ends of the tambour slats 84, of the handle 85, and of the cross member 86 are guided in door movement within spaced channel tracks 87 best shown in FIGS. 12, 13 and 14. The tracks 87 are mounted within the teller housing, one on housing side wall 74 (FIG. 14) and the other on a rear flangelike vertical divider member 88 which extends forwardly from the back wall 78 within the housing substantially midway between the side walls 74 and 75.

A similar front flangelike vertical divider 89 projects inwardly from the housing front wall 77 spaced from and aligned with the rear flangelike member 88 also located generally midway between the housing side walls 74 and 75. The dividers 88 and 89 form centrally connected car arrival and container arrival chambers 90 and 91 in the teller terminal housing. The car arrival chamber 90 is located below the main terminal top wall portion 76 (FIG. 11) and the container arrival chamber 91 is located below the access opening 82.

Guide tracks 92 and 93, for controlling cradle movement, are mounted within the car arrival chamber 90, respectively, on the rear and front divider members 88 and 89. These guide tracks 92 and 93 located within the housing provide upward extensions of spaced stabilizer track portions 94 which extend upward through the opening 80 from the tunnel similar to the stabilizing tracks 45 present in the customer terminal.

The stabilizing tracks in the teller terminal (FIG. 10) are spaced laterally of the car track upright portion 12 which extends into the teller terminal and is mounted on an upright channel 95 carried by the housing side wall 75 similar to the channel 42 which mounts the stabilizing track portion 45 within the customer terminal 8.

Figure 10:
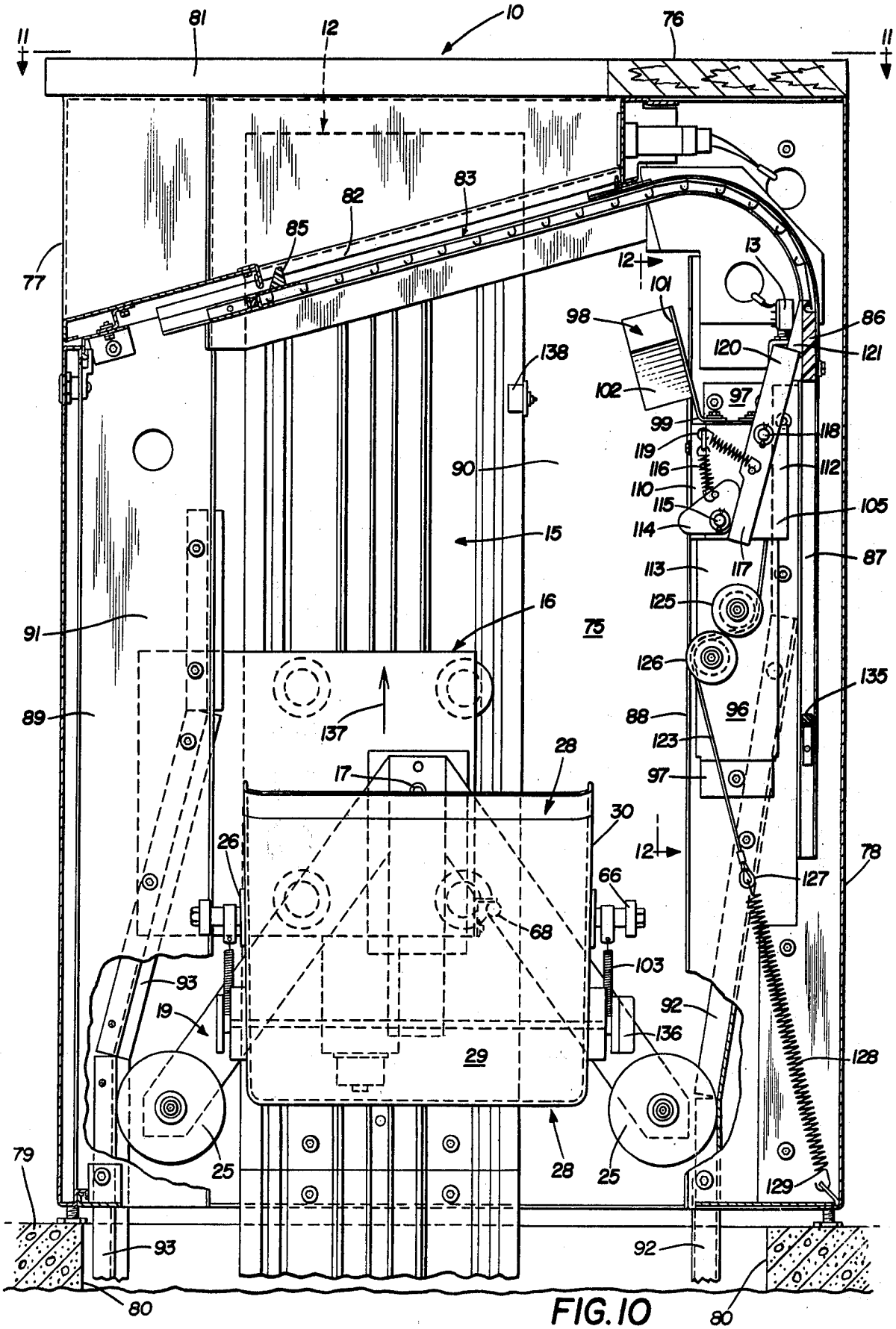
FIG. 10 is a vertical side sectional view of a teller terminal looking in the direction of the arrows 10—10, FIG. 3 showing a car-cradle-container assembly in an initial position entering the teller terminal before arriving at "home" position.

The U-shaped frame 96 is mounted by flanges 97 on flange divider member 88 and projects into the container arrival chamber 91 as shown in FIGS. 10 and 12. A bracket generally indicated at 98 has an out-turned flange 99 which is mounted on a top portion 100 of U-shaped frame 96. The bracket 98 has an upstanding body 101 from which an angular ramp 102 projects generally forwardly from the rear of the housing adjacent the divider flange member 88 (FIGS . 10, 19 and 20). This angular ramp is engaged by one of the container control rollers 66 projecting from a container end wall 30 as a container 28 is moved to the top of the teller terminal 10 in the container arrival chamber 91 (FIGS. 19 and 20).

The ramp engagement of the container control roller 66 moves the container 28 to approximately a vertical upright position on the cradle 19 against the biasing of spring 103. The spring 103 normally holds the container 28, during car movement on the trackway, tilted slightly rearwardly of the cradle 19 with the upper edge of the container side wall at the back thereof pressed against pads 104 mounted on the cradle vertical member 20 located just below the pivot support of the cradle 19 on the car 16. Each biased pad 104 engagement of the container 28 prevents container wobble during trackway movement.

Figure 15:
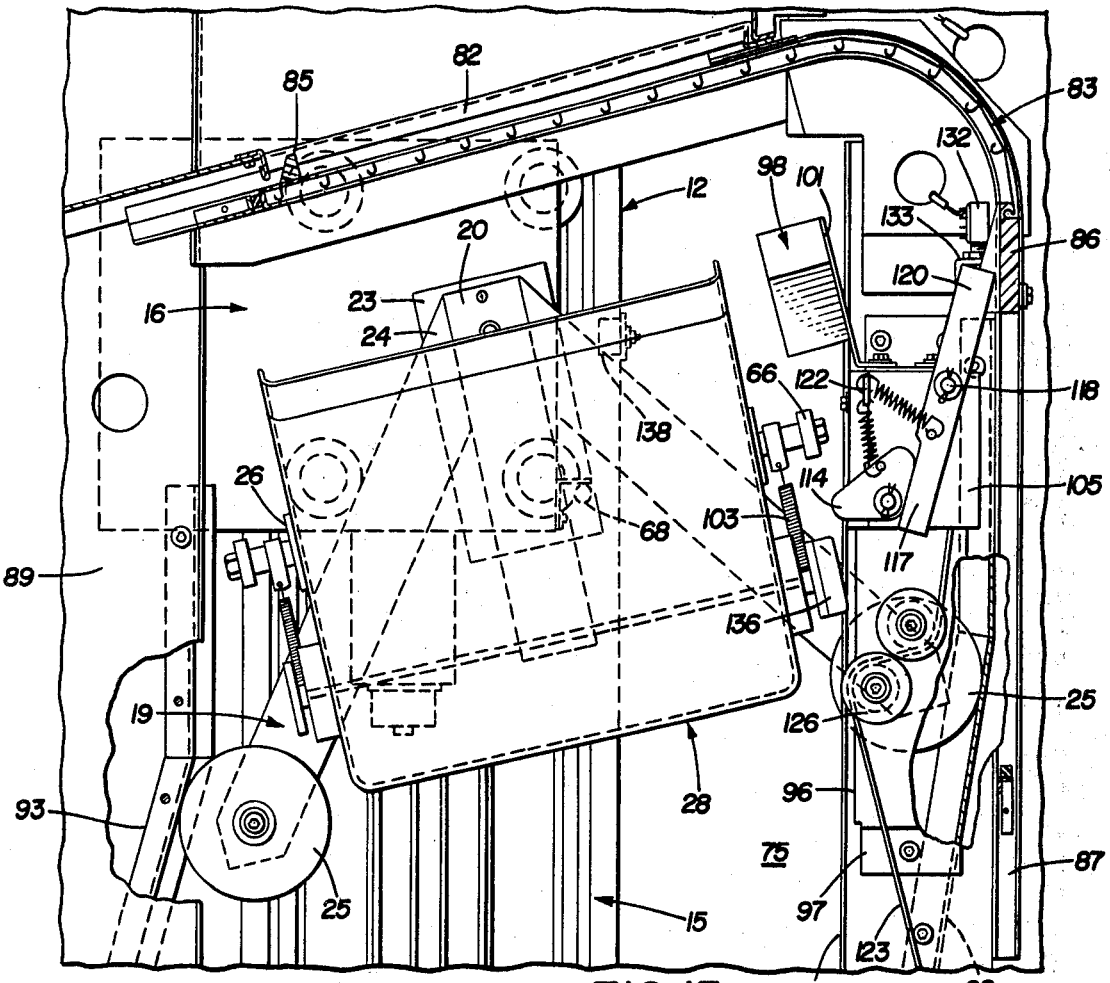
FIG. 15 is a view similar to a portion of FIG. 10 showing the cradle and container approaching "home" position in the teller terminal.
Figure 19:
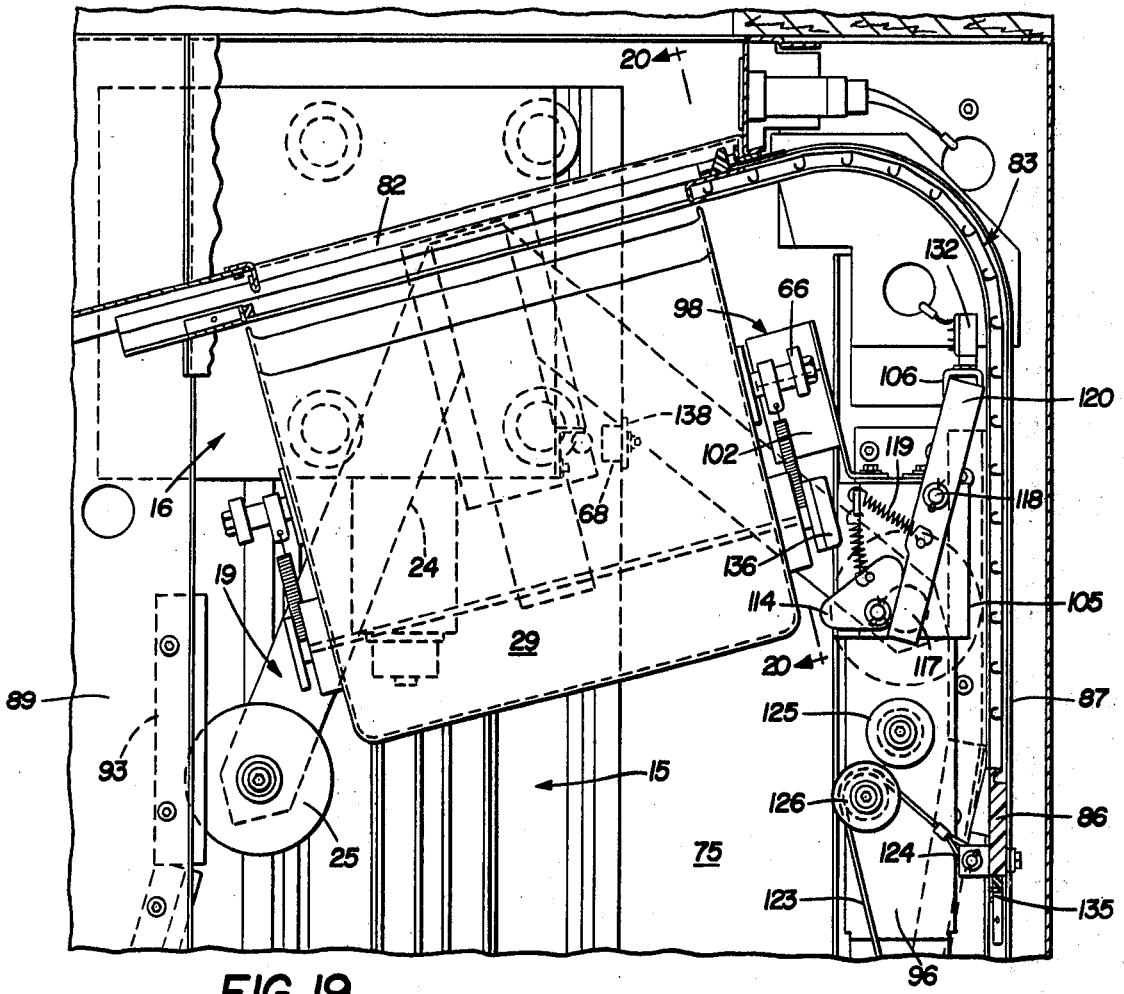
FIG. 19 is a view similar to FIG. 18 showing the container after having arrived at and stopped at "home" position.
Figure 20:
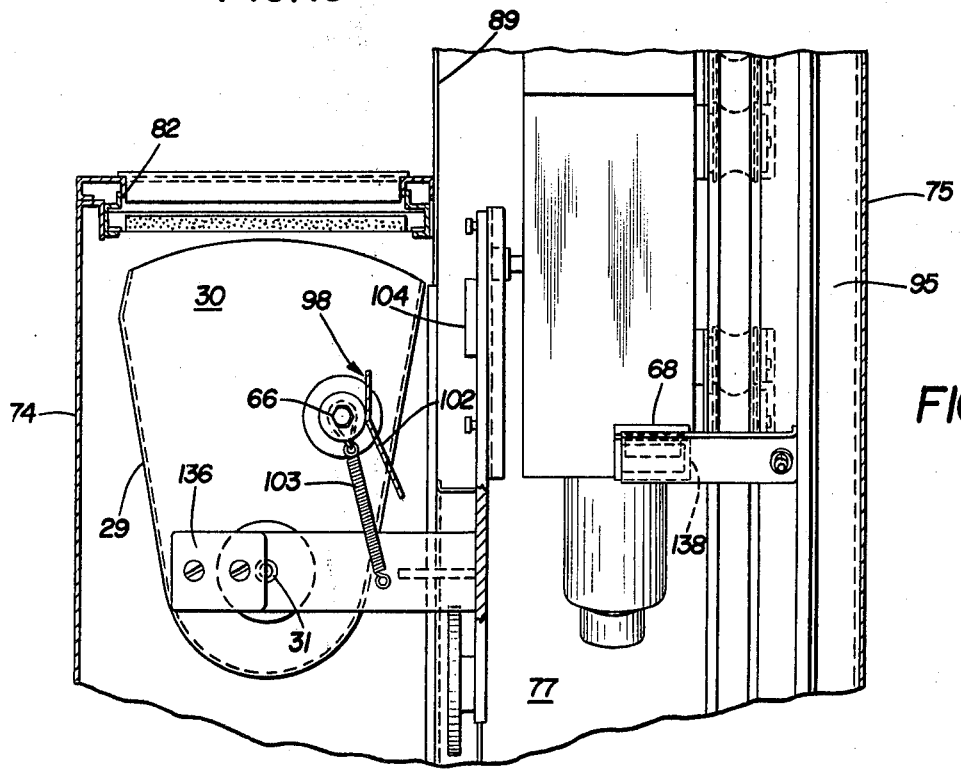
FIG. 20 is a fragmentary view looking in the direction of arrows 20—20, FIG. 19.

As the car 16 moves upward on track portion 12 into the teller terminal car arrival compartment 90, the guide tracks 92 and 93, which are angled upwardly to the right, as shown in FIGS. 10, 15 and 19, engage the cradle control rollers 25 to tilt the cradle 19 from the position of FIG. 10 to the position of FIG. 19. In this manner the container 28 pivotally mounted on the cradle is tilted endwise, to locate the open top 33 of the container parallel with the slant of the teller terminal access opening 82 as shown in FIG. 19. Thus, the container is tilted upon arrival at the teller terminal in two directions out of its normal hanging position when the container is traveling on the trackway.

Control mechanism is provided for the teller terminal door 83 which is normally latched in closed position but is automatically opened upon arrival of a car-cradle-container assembly at the teller terminal 10. This control mechanism is mounted on the U-shaped frame 96 and on an auxiliary bracket 105 and a supplemental bracket 106 both mounted on the U-shaped frame 96 (FIGS. 10, 12, 18 and 20).

The auxiliary bracket 105 has a flange 107 bolted at 108 to a flange 109 on U-shaped frame 96 (FIG. 12). Auxiliary bracket 105 then has a shoulder wall 110 extending at an angle from flange 107. An offset wall 111 extends to the right from shoulder wall 110 (FIG. 12) and terminates in a flat mounting wall 112 which is parallel with and spaced to the right of the web wall 113 of U-shaped frame 96 (FIGS. 12 and 18). Thus, the mounting wall 112 extends at a right angle from the offset wall 111, in a vertical plane perpendicular to the back teller terminal wall 78 (FIGS. 10 and 18).

A generally triangular door latch control cam 114 is pivotally mounted at 115 near the left-hand bottom corner of the mounting wall 112. Cam 114 is biased by spring 116 normally to the position shown in FIG. 10. A lever 117 is pivotally mounted at 118 intermediate its ends near the upper right-hand corner of the mounting wall 112 (FIG. 10). Lever 117 is biased normally to the position shown in FIGS. 10 and 15 by the spring 119 so that the lower end of the lever engages one flat face of the cam 114. In this position of the latch control mechanism components just described, the upper end 120 of the latch lever 117 engages beneath the catch plate 121 mounted on the door cross member 86 to hold the door 83 latched or locked in normally closed position as shown in FIG. 10.

As shown in FIGS. 12 and 18, the fixed ends of springs 116 and 119 are held by bracket 122 which is mounted on and projects from offset wall 111 (FIG. 12).

One end of a cable 123 is engaged at 124 on door cross member 86 generally midway between the ends of the cross member (FIG. 12); and the cable extends downward through a space between web wall 113 of U-shaped frame 96 and the flat mounting wall 112 of auxiliary bracket 105. The cable 123 then wraps serpentine around snubbing pulleys 125 and 126 rotatably mounted on the web wall 113 and is secured at its lower end 127 to the free end of spring 128, the other end 129 of which is hooked to the back wall 78 of the terminal housing. In this normal position of the cable tensioning mechanism, the cable 123 is under tension pulling on the door cross member 86 while the door is held latched by the latch mechanism in normally closed position as described.

The supplemental bracket 106 (FIGS. 12 and 21) is Z-shaped and its lower foot 130 is bolted at 131 to the top portion 100 of frame 96. A switch 132 is mounted on the upper foot 133 of Z-shaped supplemental bracket 106 (FIG. 21).

A switch actuator 134 is mounted on the door cross member 86 and engages and holds the switch 132 in closed position, as shown in full lines in FIG. 21, for a purpose to be described, when the door is in normally latched-closed position.

Door stop members 135 are mounted in the door channel tracks 87 adjacent the lower end of U-shaped frame 96 (FIG. 10) to limit opening movement of the door in channel tracks 87.

Referring to FIG. 5, the right-hand support member 26 of cradle 19 has a latch actuator pad 136 on the outside of its outer end for actuating the teller terminal door latch mechanism to unlatch the door 83.

Figure 16:
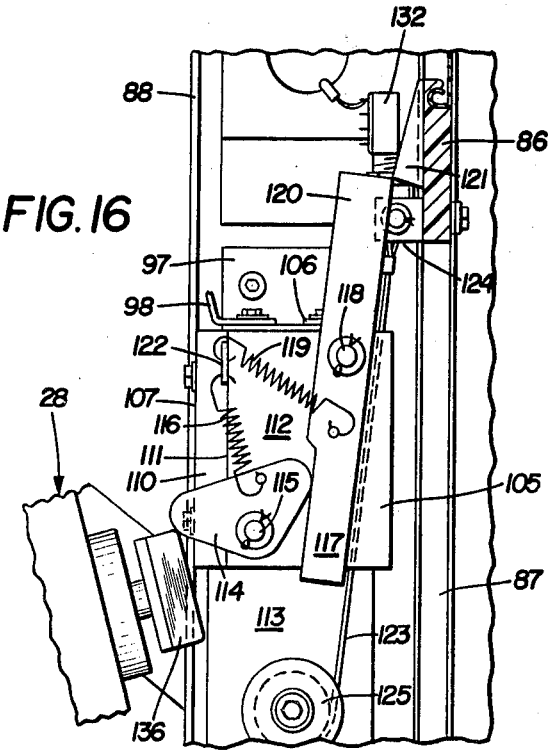
FIG. 16 is a fragmentary view similar to a portion of FIG. 15 showing a slight further approaching position of the container.

Assume that the teller terminal door 83 is in normally closed position as shown in FIG. 10 and that a car-cradle-container assembly 16-19-28 is approaching the teller terminal on the trackway, and is moving upward along track section 12 in the direction of the arrow 137. As the car 16 approaches the top portion of the teller terminal 10, the cradle 19 is tilted as described tilting the container 28 to the position shown in FIG. 15 and the pad 136 approaches the door mechanism control cam 114. During further continued upward movement of the car 16 as shown in FIG. 16 the pad 136 engages cam 114 and starts to rotate it clockwise on its pivot 115. Another portion of cam 114 is engaged with the lower portion of lever 117 and moves the lever 117 counterclockwise about its pivot 118.

Figure 17:
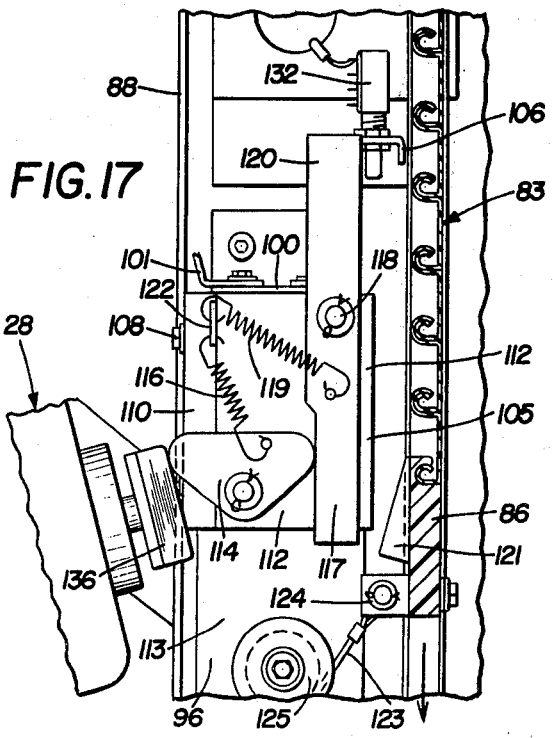
FIG. 17 is a view similar to FIG. 16 illustrating a still further approach of the container to "home" position.

During further continued upward car movement, the cradle pad 136 continues rotation of the cam 114 as shown in FIG. 17 and the cam 114 moves lever 117 to disengage its upper end 120 from the door catch plate 121 releasing the door.

When the door is thus released, further continued movement of the car upward to its final position shown in FIG. 19 releases pad 136 from cam 114 whereupon cam 114 returns to normal position biased by its spring 116 and the lever 117 returns to its normal position as shown in FIG. 19 biased by its spring 119.

The container 28 at the final car position in teller terminal 10 is tilted by the ramp 102 engaging the container control roller 66 as described, the container also having been tilted endwise by cradle pivot movement on the car also as described.

A reed switch 138 is mounted at the upper end of the track section 12 of the trackway in the teller terminal 10 similar to the reed switch 69 mounted in the customer terminal 8. As the car 16 approaches the top of the teller terminal 10, the magnet 68 on the car approaches the reed switch 138 and actuates the reed switch to de-energize the drive motor of the self-propelled car 16 so as to stop the car-cradle-container assembly movement upon arrival thereof at the access opening of the teller terminal.

At this time, as just described, the teller terminal door 83 is automatically released and opened. The door opening movement is accomplished after release of the door catch plate 121 by the latch mechanism, by pull of the cable 123 from the tension of the spring 128 on the door cross member 86, whereupon the cross member 86 moves downward in channel tracks 87 until it engages the door stop member 135 as shown in FIG. 17.

Meanwhile, the switch actuator 134 (FIG. 21) has released the switch 132 permitting the switch to de-energize the control circuitry for the equipment.

The teller terminal door 83 having been opened with the container 28 tilted in the manner described, enables a teller 2 to see the entire interior of the container 28 and readily to process banking material therein. If further banking material is to be returned to a customer at a connected customer station, the material is deposited in the container 28 and it is then necessary for the teller manually to close the door against the pull of the spring-tensioned cable 123 by grasping the front door handle 85 and pulling the door to closed position. During such door closing movement, the catch plate 121 reaches over the upper end of latch lever 117 to latch the door in normally closed position.

At the same time as the door reaches closed position, the switch actuator 134 actuates switch 132 as shown in FIG. 21. The switch 132, when thus actuated, indicates that the door is closed and re-energizes the operation circuitry so that the car-cradle-container assembly may be transported along the trackway to the paired customer terminal when the teller pushes a "send-button" connected in the operation circuitry at the teller terminal 10 to energize the car for movement along the trackway.

The teller terminal control buttons generally indicated at 73 in FIGS. 3 and 9, may include a power button **73*a* which the teller may actuate to energize the control circuit for the paired teller-customer terminal system; a send-button 73*b* which the teller actuates to send a car, after the teller terminal door 83 has been closed, to the customer terminal 8; and a return or bring-back button 73*c* which the teller actuates to initiate car travel from the customer terminal 8 to the teller terminal 10**.

A key lock is diagrammatically indicated at 140 in FIG. 2 for unlocking a panel in the customer terminal 8 for access to the interior of the housing to perform adjustments, repairs, etc. Several buttons may be provided in the upper portion of the front wall 36 of the customer terminal 8 initiating or actuating operations including service-requested button 141 which a customer presses to gain the attention of a teller; and a send-button 142 which a customer presses to send the car back to the teller terminal 10, after depositing banking material into a container 28 presented through the access opening of the customer terminal 8.

A microphone is indicated generally at 143 and a speaker at 144 at the customer terminal 8 (FIG. 2) for audio communication between the customer and teller, similar components being present at the teller terminal 10.

The multiple pivot mounting of the container 28 on the car 16 has been referred to in the foregoing description. This feature of the equipment enables the open top container 28 to be tilted to different positions at the customer and teller terminals for convenient access to the container 28 at these locations, respectively, by the customer or teller.

In FIG. 4 the diagrammatic illustration of the container 28 at X illustrates the endwise tilting of the container at the teller terminal, and the lateral outward tilting of the container 28 at the customer terminal 8 is illustrated diagrammatically at Z. The diagrammatic illustration of the car-cradle-container assembly at Y illustrates the container position while traveling along the trackway with its upper edge biased against the cradle pads 104.

These features, among others described, enable the equipment to carry out commercial banking operations involving transporting banking material loads of twenty-five or more pounds in remote banking equipment heretofore impossible to be transported in remote pneumatic tube banking service equipment.

Furthermore, the customer and teller terminals, trackway system, guide channels and car-cradle-container components are characterized by interrelationships which automatically open the normally closed and locked terminal access opening doors upon car arrival at a terminal, and which automatically latch the doors closed when the doors move to closed position.

Normally during the time period when a remote banking installation is open for banking operations a teller 2 at the teller station 1 will have pressed a power button 73*a* for any one or more or all of the paired teller-customer terminals to energize the control circuitry for any such paired terminals. Normally the car-cradle-container assembly is parked or located at a teller terminal. Presumably the teller terminal door 83 is closed at each teller terminal located at the teller station 1.

A customer arrives at a remote drive-up customer station 6 and presses a service request button 141 at the customer terminal 10 which alerts the teller to the customer's presence, for example, by sounding a buzzer in the audio system.

The teller then presses a send button 73*b* for the teller terminal paired with the customer terminal from which the service request was signaled. If the particular teller terminal door 83 has not been closed, the teller must close the door 83 manually so that the door actuates door closed switch 132 to enable the car motor to be energized when the teller send-button 73*b* is actuated.

The car motor thus being energized propels the car from the teller terminal 10 to the paired customer terminal 8 where on car arrival at the customer terminal its door 41 is automatically opened and the car is stopped upon actuation of the customer terminal reed limit switch 69 by the car mounted magnet 68 (FIGS. 7 and 8).

The customer places the banking transaction material into the outwardly tilted large open top 33 of the large container 28. Such banking material of the commercial type may include bulky documents, which the large container can handle, or a considerable amount of coin in rolls, or both. The customer then presses the customer terminal send-button 142, whereupon the car motor is energized and the car moves out of the customer terminal 8, the customer terminal door 41 automatically closing and being latched closed. The car then travels with its assembled cradle and container to the teller terminal 10 and upon arrival automatically opens the teller terminal door 83 in the manner described, the car being stopped when its magnet 68 actuates teller terminal reed switch 138.

The teller processes the transaction, returns transaction material to the container 28, including coin if requested by the customer, and manually closes the door 83, and then actuates the send-button 73*b* which energizes the car motor and the car travels to the customer station where the door 41 automatically opens so that the customer can remove the banking transaction material from the container 28 which was transported to him in the container.

The customer then presses the customer terminal send-button 142 which he is requested to do, either over the audio equipment by the teller, or by a sign on the customer terminal. If the customer fails to do so the teller returns the car-cradle-container assembly to the teller terminal 10 by pressing the teller terminal return-button 73*c*.

Typical known control circuitry for energizing a car motor and reversing car movement is utilized, such as control circuitry for the car travel on a trackway in U.S. Pat. No. 4,015,537. Similarly, known control circuitry for the remote pneumatic tube banking system of U.S. Pat. No. 4,059,246 may be utilized for the control of transporting banking material between customer and teller stations with the equipment of the invention. The equipment of the invention is amplified by providing automatic opening of the teller and customer terminal doors on arrival of the car-cradle-container assembly at such terminal, by providing the automatic locking of the doors closed when closed, and by providing the car magnet and terminal reed switches which act as travel limit switches in a well-known manner.

Accordingly, the concepts of the various aspects of the invention described in detail provide a new-duty railway transport construction and system primarily for commercial multiple customer station remote banking operations which achieve the stated objectives, eliminate difficulties that have arisen with prior devices in attempting to transport heavy and bulky banking material loads, and solve problems and obtain the described new results.

In the foregoing description certain terms have been used for brevity, clearness and understanding, but no unnecessary limitations are to be implied therefrom, beyond the requirements of the prior art, because such terms are used for descriptive purposes and are intended to be broadly construed.

Moreover, the description and illustration of the invention are by way of example, and the scope of the invention is not limited to the exact details shown or described.

Having now described the features, discoveries and principles of the invention, the manner in which the equipment is constructed and operated, and the advantageous, new and useful results obtained, the new and useful structures, devices, elements, arrangements, parts, combinations, operations, interrelationships, systems and equipment are set forth in the appended claims.

I claim:

1. Banking service transport equipment for carrying out banking transactions between a teller station and a remote customer station, including a teller terminal, a customer terminal, and a self-propelled car transport mechanism connecting said teller and customer terminals of a type in which a car travels along a track system having horizontal and vertical track runs with curves between horizontal and vertical runs and a corner curve between horizontal run portions; a container; and multi-axis pivotal mechanism suspending the container from the car for pivotal movement on a first pivot axis at one of said teller and customer terminals and on a second pivot axis oriented at right angles to said first axis at the other of said terminals; said multi-axis mechanism having a cradle pivotally mounted on the car on a horizontally extending axis; and the container being pivotally mounted on the cradle on an axis spaced from and extending at right angles to the axis on which the cradle is pivoted; whereby the car, cradle and container form a car-cradle-container assembly that travels along the track system to and between said teller and customer terminals.

2. Banking service transport equipment for carrying out banking transactions between a teller station and a remote customer station, including a teller terminal, a customer terminal, and a self-propelled car transport mechanism connecting said teller and customer terminals of a type in which a car travels along a track system having horizontal and vertical track runs with curves between horizontal and vertical runs and a corner curve between horizontal run portions; a container having bottom, side and end walls and a generally rectangular open top having a length between end walls greater than it width; and multi-axis pivotal mechanism suspending the container from the car for pivotal movement on a first pivot axis at one of said teller and customer terminals and on a second pivot axis oriented at right angles to said first axis at the other of said terminals; said multi-axis mechanism having a cradle pivotally mounted on the car; and said container being pivotally mounted on the cradle on pivot pins projecting from the container end walls axially parallel with the container side walls to enable the container to be tilted laterally at a normally door-closed access opening for the customer terminal when the car and cradle and container arrive at the customer terminal and the door is opened.

3. Banking service transport equipment for carrying out banking transactions between a teller station and a remote customer station, including a teller terminal, a customer terminal, and a self-propelled car transport mechanism connecting said teller and customer terminals of a type in which a car travels along a track system having horizontal and vertical track runs with curves between horizontal and vertical runs and a corner curve between horizontal run portions; a container having bottom, side and end walls and a generally rectangular open top having a length between end walls greater than its width; and multi-axis pivotal mechanism suspending the container from the car for pivotal movement on a first pivot axis at one of said teller and customer terminals and on a second pivot axis oriented at right angles to said first axis at the other of said terminals; said multi-axis mechanism having a cradle pivotally mounted on the car and the container being pivotally mounted on the cradle; and the container being tilted endwise pivotally on the car-cradle pivotal mounting at a normally door-closed access opening for the teller terminal when the car and cradle and container arrive at the teller terminal and the door is opened.

4. Banking service transport equipment for carrying out banking transactions between a teller station and a remote customer station, including a teller terminal, a customer terminal, and a self-propelled car transport mechanism connecting said teller and customer terminals of a type in which a car travels along a track system having horizontal and vertical track runs with curves between horizontal and vertical runs and a corner curve between horizonal run portions; a container; and multi-axis pivotal mechanism suspending the container from the car for pivotal movement on a first pivot axis at one of said teller and customer terminals and on a second pivot axis oriented at right angles to said first axis at the other of said terminals; said teller and customer terminals each having an access opening; there being a door for each access opening; each door being mounted on its respective terminal movable between closed and open positions; and each door having latch mechanism normally locking such door in closed position; said multi-axis mechanism having a cradle pivotally mounted on the car and the container being pivotally mounted on the cradle; and the cradle engaging said latch mechanism respectively at each of said teller and customer terminals to unlatch such door upon arrival of the car and cradle and container at such terminal thereby enabling the unlatched door to open.

5. The construction defined in claim 4 in which the teller terminal door is biased to automatically open when its latch mechanism is unlatched.

6. The construction defined in claim 4 in which the customer terminal door latch mechanism is engaged by the cradle to unlatch the door and then to move the door to open position.

7. Banking service transport equipment for carrying out banking transactions between a teller station and a remote customer station, including a teller terminal, a customer terminal, and a self-propelled car transport mechanism connecting said teller and customer terminals of a type in which a car travels along a track system having horizontal and vertical track runs with curves between horizontal and vertical runs and a corner curve between horizontal run portions; a container; and multi-axis pivotal mechanism suspending the container from the car for pivotal movement on a first pivot axis at one of said teller and customer terminals and on a second pivot axis oriented at right angles to said first axis at the other of said terminals; said multi-axis mechanism having a cradle pivotally mounted on the car, and the container being pivotally mounted on the cradle; said teller and customer terminals each having an access opening provided with a door movable between closed and open positions; and each terminal being provided with actuator means engageable with one of the cradle or container, for tilting the container to differently oriented positions at the access opening of each terminal when the door for such terminal access opening is in open position.

8. The construction defined in claim 7 in which the means in the teller terminal for tilting the container engages the cradle to tilt the container pivotally on the car pivot axis on which the cradle is mounted at the teller terminal access opening when the door for the teller terminal access opening is in open position.

9. The construction defined in claim 7 in which the means in the customer terminal for tilting the container engages the container to tilt the container pivotally on the cradle at the customer terminal access opening when the door for the customer terminal access opening is in open position.

10. Banking service transport equipment for carrying out banking transactions between a teller station and a remote customer station, including a teller terminal, a customer terminal, and a self-propelled car transport mechanism connecting said teller and customer terminals of a type in which a car travels along a track system having horizontal and vertical track runs with curves between horizontal and vertical runs and a corner curve between horizontal run portions; a cradle pivotally mounted on the car on a horizontally extending axis, and a container pivotally mounted on the cradle on an axis spaced from and extending at right angles to said cradle pivot axis to form a car-cradle-container assembly; said teller and customer terminals each having an access opening provided with a door movable between closed and open positions; and means in each terminal engageable with the car-cradle-container assembly for tilting the container to differently oriented positions at the access opening of each terminal when the door for such terminal access opening is in open position.

11. The construction defined in claim 10 in which the means in the customer terminal engageable with the car-cradle-container assembly for tilting the container includes curved container control track means in the terminal engageable with control rollers on the container, as a car-cradle-container assembly arrives at the customer terminal to tilt the container laterally outward of the customer terminal access opening on arrival of said assembly at the customer terminal.

12. The construction defined in claim 11 in which the container has bottom, side and end walls and a generally rectangular open top having a length between end walls greater than its width; in which the pivot mounting of the container on the cradle includes pivot pins pivoted on the cradle; in which said pivot pins project from the container end walls axially parallel with the container side walls; and in which the control rollers project axially parallel with said pivot pins from the container end walls spaced the pivot pins and adjacent the container open top.

13. The construction defined in claim 10 in which the customer terminal access opening door is normally latched closed and is automatically opened on arrival of the car-cradle-container assembly at the customer terminal.

14. The construction defined in claim 10 in which the car-cradle-container assembly unlatches the customer terminal door and opens the door by movement of said assembly into the customer terminal as said assembly arrives at the customer terminal.

15. The construction defined in claim 14 in which the cradle has support arms projecting outwardly from the car on which it is pivotally mounted; in which the support arms actuate the customer terminal door latch and move the door to open position during arrival movement of said assembly into the customer terminal.

16. Banking service transport equipment for carrying out banking transactions between a teller station and a remote customer station, including a self-propelled car transport mechanism connecting said teller and customer stations of a type in which a car travels along a track system having horizontal and vertical track runs which curves between horizontal and vertical runs and a corner curve between horizontal run portions; a container; means suspending the container from the car including a cradle pivotally mounted on a horizontal axis on the car, and means mounting the container on the cradle to form a car-cradle-container assembly; a teller terminal at the teller station; the teller terminal having a housing provided with an access opening; door means for said access opening; channel track means mounted in the housing in spaced relation adjacent opposite sides of said access opening; said door means including flexibly connected roll-top slat member oriented laterally of the access opening and having end portions engaged and movable in said channel track means in directions normal to the lateral extent of said slats between door-closed and open positions; and latch mechanism in the terminal housing for said door means normally locking such door means in closed position.

17. The construction defined in claim 16 in which the door is biased to open position when said latch mechanism is unlatched; in which the cradle has support members on which container is mounted; and in which one of said cradle support members unlatches said latch mechanism when the cradle is tilted as the assembly arrives at the teller terminal.

18. The construction defined in claim 16 in which the latch mechanism includes a lever pivotally mounted intermediate its ends in the housing biased normally to engage one lever end with a latch plate on the teller terminal door means, a latch control cam pivotally mounted in the housing biased normally to engage the other lever end, said control cam being movable on its pivot mounting in one direction to disengage said one lever end from said latch plate; in which the door means has a manual actuating handle at one end accessible in both door-closed and door-open positions at the teller terminal access opening; in which the door means has a cross member at its end remote from said handle on which said latch plate is mounted; in which the cradle has support members on which the container is mounted; in which one of said cradle support members engages said control cam to move it in said one direction to disengage said one lever end from said latch plate when the cradle is tilted as the assembly arrives at the teller terminal; and in which the door means is biased to open position when the latch mechanism is unlatched.

19. The construction defined in claim 16 in which the cradle engages the teller terminal latch mechanism to unlatch the door means upon arrival of the car-cradle-container assembly at the teller terminal thereby enabling the unlatched door means to open.

20. The construction defined in claim 19 in which the teller terminal door means is biased to automatically open when its latch mechanism is unlatched.

21. The construction defined in claim 16 in which means is provided in the terminal housing engageable with the cradle for tilting the container on the cradle horizontal pivot axis at the access opening when the door means for the access opening is in open position.

22. The construction defined in claim 21 in which the container is pivotally mounted on the cradle on an axis spaced below and extending normal with respect to the pivot axis of the cradle on the car; and in which the container is biased against movement on its pivot axis on the cradle when the container is tilted on the cradle horizontal pivot axis.

23. The construction defined in claim 16 including spaced cradle control tracks mounted in the housing having vertical and connected upward angularly extending portions, cradle control rollers journaled at spaced locations on the cradle below the cradle pivot axis, and said control rollers engaging said angularly extending track portions to tilt the cradle laterally on said cradle pivot axis as the assembly arrives at the teller terminal.

24. The construction defined in claim 23 in which the container has bottom, side and end walls and a generally rectangular open top having a length between end walls greater than its width and in which the container is tilted endwise when the cradle is tilted laterally on said cradle pivot axis when the assembly arrives at the teller terminal.

25. Banking service transport equipment for carrying out banking transactions between a teller station and a remote customer station, including a self-propelled car transport mechanism connecting said teller and customer stations of a type in which a car travels along a track system having horizontal and vertical track runs with curves between horitontal and vertical runs and a corner curve between horizontal run portions; a container; means suspending the container from the car including a cradle pivotally mounted on a horizontal axis on the car, and means pivotally mounting the container on the cradle to form a car-cradle-container assembly; a customer terminal at the customer station; the customer terminal having a housing provided with an access opening; door means for said access opening; channel track means mounted in the housing in spaced relation adjacent opposite sides of said access opening; said door means including a rectangular carrige frame having guide rollers mounted at its corners engaged and movable in said channel track means, a door mounted on the carriage and movable with the carriage within the housing between access opening closed and open positions; latch mechanism mounted on the carriage frame normally latching the door means closed when the door is in closed position; and means on the assembly engaging and unlatching said latch mechanism and moving said door means to door-open position as the assembly arrives at the customer terminal.

26. The construction defined in claim 25 in which the door is pivotally mounted on the carriage frame on a pivot shaft at the top of the frame on which certain of said carriage guide rollers are mounted; in which curved door guide track means are mounted in spaced relation in the housing connected with said channel track means; door guide rollers on the door spaced from the door pivot mounting on the carriage engageable and movable in said curved guide track means to tilt the door in the housing as the door means is moved to open position.

27. The construction defined in claim 25 in which the latch mechanism includes a latch member provided with a latch finger biased to normally door-closed latched position; and in which the latch finger engages a latch plate mounted within the housing when in latched position.

28. The construction defined in claim 25 in which the latch mechanism has a latch member pivotally mounted on the carriage frame; in which an arm projects from the cradle to engage and unlatch the latch mechanism and thereafter to move the door means to door-open position as the assembly arrives at the customer terminal.

29. The construction defined in claim 28 in which the cradle arm supporting the door means through the latch mechanism latch member is unlatched position releases the latch member and door means supported through the latch meahanism on the cradle arm during assembly movement out of the customer terminal so that the latch member normally biased to latched position latches the door means in closed position.

30. The construction defined in claim 28 in which means mounted in the housing engage container control means on the container to pivotally tilt the container outward of the access opening as the container door means is moved to open position.

31. The construction defined in claim 30 in which spring means is provided engaging the container and cradle to bias the container from a tilted to upright position on the car-cradle-container assembly within the customer terminal housing when the assembly moves out of the customer terminal.

32. Banking service transport equipment for carrying out banking transactions between a teller station and a remote customer station, including a self-propelled car transport mechanism connecting said teller and customer stations of the type in which a car travels along a track system having horizontal and vertical track runs with curves between horizontal and vertical runs and a corner curve between horizontal run portions; a cradle, the cradle including a vertical member pivotally supported at its upper end on a first pivot member projecting on a horizontal axis laterally from the car, the vertical member having portions extending downward from said first pivot axis, cradle control rollers journaled at spaced locations below said first pivot axis on said downwardly extending portions, and spaced support members projecting laterally from said downwardly extending portions and parallel with and spaced below said first pivot axis; a container having an open top; and means pivotally supporting the container on outer end portions of said cradle support members on a second pivot axis extending at right angles to said first axis.

33. The construction defined in claim 32 in which one of said teller and customer stations has spaced cradle control tracks having vertical and connected upward angularly extending portions, and in which said angularly extending track portions engage the cradle control rollers to tilt the cradle laterally on said first pivot axis as the car arrives at said one station.

34. The construction defined in claim 33 in which said container has bottom, side and end walls and a generally rectangular open top having a length between end walls greater than its width; in which the container is tilted endwise when the cradle is tilted laterally on said first pivot axis; and in which said one station is a teller station.

35. The construction defined in claim 34 in which the teller station has a teller terminal; in which the teller terminal has an access opening; in which a door is provided for said access opening movable between closed and open positions; in which latch mechanism is mounted in the teller terminal for said door normally locking the door in closed position; in which the door is biased to open position when said latch mechanism is unlatched; and in which one of said cradle support members unlatches said latch mechanism when the cradle is tilted as the car arrives at the teller station.

36. The construction defined in claim 35 in which the container is normally biased on its pivot mounting on the cradle to engage a top portion of one container side wall with a cradle member to stabilize the container during car-cradle-container movement along the track system; in which container control rollers are journaled on the container end walls spaced above the container pivot mounting on the cradle; and in which a ramp is mounted in the teller terminal engaging one of said container control rollers as the car arrives at the teller station to move the container to vertically oriented position on its pivot mounting on the cradle.

37. The construction defined in claim 36 in which the teller terminal door has a handle for manually closing the door against its normal bias to open position; and in which a doorclosed-indicating switch is actuated when the door is moved to and latched in closed position.

* * * * *

UNITED STATES PATENT AND TRADEMARK OFFICE

CERTIFICATE OF CORRECTION

PATENT NO. : 4,411,336
DATED : October 25, 1983
INVENTOR(S) : Walter G. Anders

It is certified that error appears in the above-identified patent and that said Letters Patent are hereby corrected as shown below:

In the Abstract, fourth line from the end, the word "of" should be - or - ;
Column 3, line 58, change "applicants have" to - applicant has -;
Column 7, line 14, after second occurrence of the word "the", the number should be corrected to read - 7 1/2" - ;
Column 14, line 55, change "new-duty" to - new heavy-duty - ;
Column 17, line 57, after the word "spaced" insert the word - above - ;
Column 17, line 64, change the numeral "10" to - 13 - ;
Column 18, line 13, change "which" to - with - ;
Column 19, line 47, change "carrige" to - carriage - ;
Column 20, line 16, change "is" to - in - ;
Column 22, line 13, change "doorclosed-indicating" to - door-closed-indicating -

Signed and Sealed this

Ninth Day of October 1984

[SEAL]

Attest:

GERALD J. MOSSINGHOFF

Attesting Officer

Commissioner of Patents and Trademarks